US008425132B2

(12) United States Patent
Bouverie et al.

(10) Patent No.: US 8,425,132 B2
(45) Date of Patent: Apr. 23, 2013

(54) MODULAR PRINTER

(75) Inventors: William M Bouverie, Windermere, FL (US); Kenneth Colonel, Oviedo, FL (US); Christopher Roy Christensen, Gotha, FL (US); Dwayne Tobin, Longwood, FL (US); Jay Huberty, Gotha, FL (US); Ron Consiglio, Clermont, FL (US); Fred Scofield, Orlando, FL (US); Mary Hitz, Lake Mary, FL (US); George Vazac, Apopka, FL (US); Richard Hatle, Oviedo, FL (US)

(73) Assignee: Datamax-O'Neil Corporation, Orlando, FL (US)

( * ) Notice: Subject to any disclaimer, the term of this patent is extended or adjusted under 35 U.S.C. 154(b) by 100 days.

(21) Appl. No.: 12/715,693

(22) Filed: Mar. 2, 2010

(65) Prior Publication Data

US 2010/0247222 A1 Sep. 30, 2010

Related U.S. Application Data

(60) Division of application No. 11/210,535, filed on Aug. 24, 2005, now Pat. No. 7,699,550, which is a continuation-in-part of application No. 10/668,943, filed on Sep. 22, 2003, now Pat. No. 7,042,478, which is a continuation-in-part of application No. 10/634,000, filed on Aug. 4, 2003, now Pat. No. 6,846,121, which is a continuation of application No. 09/965,533, filed on Sep. 26, 2001, now Pat. No. 6,616,362, which is a continuation of application No. PCT/US00/08051, filed on Mar. 27, 2000.

(60) Provisional application No. 60/126,499, filed on Mar. 26, 1999, provisional application No. 60/412,481, filed on Sep. 20, 2002.

(51) Int. Cl.
*B41J 15/04* (2006.01)

(52) U.S. Cl.
USPC ..... 400/613; 347/198; 347/222

(58) Field of Classification Search ..... 347/198; 400/613
See application file for complete search history.

(56) References Cited

U.S. PATENT DOCUMENTS 4,019,935 A 4/1977 Harvey
4,732,502 A 3/1988 Yokoi (Continued)

FOREIGN PATENT DOCUMENTS

DE 2802104 B1 1/1978
EP 0195949 A2 2/1986

(Continued)

*Primary Examiner* — Daniel J Colilla
*Assistant Examiner* — Nguyen Q Ha
(74) *Attorney, Agent, or Firm* — Carter, DeLuca, Farrell & Schmidt, LLP

(57) ABSTRACT

A modular printer having a media take-up assembly, a support block assembly, a printhead assembly, a stepper motor assembly and a display assembly is provided. A support housing having a plurality of recesses formed on an internal wall of the modular printer is also provided. Each of the recesses is configured to receive and align one of the modular printer assemblies with the other modular printer assemblies. Each of the assemblies is configured as a module which can be easily accessed and quickly secured to or detached from the support housing. The support housing is adapted to receive assembly modules for both thermal ink printers and ribbon ink printers such that the modular printer can be easily converted from one to the other.

12 Claims, 31 Drawing Sheets

U.S. PATENT DOCUMENTS 4,776,714 A 10/1988 Sugiura et al.
4,795,281 A 1/1989 Ulinski, Sr. et al.
5,067,832 A 11/1991 Baur et al.
5,103,259 A 4/1992 Saitoh et al.
5,195,837 A 3/1993 Steppe et al.
5,198,836 A * 3/1993 Saito et al. ..... 347/222
5,320,437 A 6/1994 Malke et al.
5,344,248 A 9/1994 Schoon et al.
5,438,349 A 8/1995 Fox et al.
5,442,449 A 8/1995 Stemmle et al.
5,501,537 A 3/1996 Kohno
5,507,583 A 4/1996 Beaty et al.
5,534,890 A 7/1996 Krug et al.
5,563,686 A 10/1996 Beaufort et al.
5,564,845 A 10/1996 Yamaguchi et al.
5,570,962 A 11/1996 Suzuki et al.
5,587,728 A 12/1996 Edgar
5,588,761 A 12/1996 Seib
5,613,790 A 3/1997 Miazga
5,619,240 A 4/1997 Pong et al.
5,650,730 A 7/1997 Herbst, Jr.
5,657,066 A * 8/1997 Adams et al. ..... 347/198
5,707,162 A 1/1998 Kasai et al.
5,790,162 A 8/1998 Adams et al.
5,802,973 A 9/1998 Mueller et al.
5,820,279 A 10/1998 Lodwig et al.
5,833,377 A 11/1998 Keller et al.
5,872,585 A 2/1999 Donato et al.
5,874,980 A 2/1999 West
5,909,233 A 6/1999 Hamman et al.
5,927,875 A 7/1999 Lau et al.
5,938,350 A 8/1999 Colonel
5,995,128 A 11/1999 Adams et al.
6,020,906 A 2/2000 Adams et al.
6,030,133 A 2/2000 Endo
6,034,708 A 3/2000 Adams et al.
6,057,870 A 5/2000 Monnier et al.
6,074,031 A * 6/2000 Kahle ..... 347/4
6,130,699 A 10/2000 Christensen et al.
6,145,769 A 11/2000 Shiraishi et al.
6,231,253 B1 * 5/2001 Henderson et al. ..... 400/618
6,232,996 B1 5/2001 Takahashi et al.
6,396,070 B1 5/2002 Christensen et al.
6,412,991 B1 7/2002 Klinefelter et al.
6,616,362 B2 9/2003 Bouverie et al.
6,962,451 B2 11/2005 Narita et al.
7,042,478 B2 * 5/2006 Bouverie et al. ..... 347/177
2002/0012559 A1 1/2002 Takahashi et al.

FOREIGN PATENT DOCUMENTS

EP 0798122 A2 1/1997
JP 55101484 A * 8/1980
JP 56037850 A 4/1981
JP 56051377 A * 5/1981
JP 60204559 A 10/1985
JP 03213372 A * 9/1991
JP 04008551 A * 1/1992
JP 04-112063 4/1992
JP 05147782 A 6/1993
JP 10224566 A * 8/1998
JP 11105364 A 4/1999

* cited by examiner

MODULAR PRINTER

CROSS-REFERENCE TO RELATED APPLICATIONS

This application is a divisional of U.S. patent application Ser. No. 11/210,535, filed Aug. 24, 2005, which is a continuation-in-part of U.S. patent application Ser. No. 10/668,943, filed Sep. 22, 2003, which is a continuation-in-part of U.S. application Ser. No. 10/634,000, filed Aug. 4, 2003, now U.S. Pat. No. 6,846,121, which is a continuation of U.S. application Ser. No. 09/965,533, filed Sep. 26, 2001, now U.S. Pat. No. 6,616,362, which is a continuation of PCT Application No. PCT/US00/08051, filed Mar. 27, 2000, which claims priority from U.S. Provisional Application Ser. No. 60/126,499, filed on Mar. 26, 1999. The contents of these prior applications are incorporated herein by reference in their entirety. This application also claims priority from U.S. Provisional Application Ser. No. 60/412,481, filed Sep. 20, 2002, the contents of which is incorporated herein by reference in its entirety.

BACKGROUND

1. Technical Field

The present disclosure relates to printers in general and more particularly to a modular printer assembly having components configured as modules which can be easily and quickly removed and/or secured to the assembly to perform basic maintenance and/or convert the printer assembly from a thermal ink printer to a ribbon ink printer.

2. Background of Related Art

Thermal ink printers and ribbon ink printers are well known and widely used. These printers include a variety of complex components enclosed within a housing. Typically, the components are arranged in such a manner that it is difficult to access any one or all of the components to perform basic maintenance and repair. Thus, operational downtime to perform basic repairs and maintenance is prolonged and reliance on the availability of a service technician to maintain a printer operational is assured.

Conventional printers, as mentioned briefly above, include both thermal ink printers and ribbon ink printers. Thermal ink printers and ink ribbon printers include a majority of common components. Despite this fact, if an operator required or desired both a thermal ink printer and an ink ribbon printer, the operator would have to purchase two separate units at increased expense.

Accordingly, a need exists for a printer which is capable of operating as both a thermal ink printer and a ribbon ink printer. Moreover, a need exists for an improved, less complex printer having easily accessible internal components which facilitate speedy maintenance and repair by a service technician and/or the printer operator.

SUMMARY OF THE INVENTION

In accordance with the present disclosure, a modular printer having a support housing is provided. The modular printer includes a media take-up assembly, a support block assembly, a printhead assembly, a media sensor assembly, a drive motor assembly, a cover assembly and a display assembly. Electrical circuitry in the form of circuit boards is provided to provide power where required. The support housing defines an internal support wall having a plurality of recesses formed therein. Each recess is configured to receive one of the modular printer assemblies. Each assembly defines a separate module which can be independently secured to or removed from the support wall. The printing assemblies or modules are secured to one side of the support wall and the electric motor assembly and circuitry are secured to the opposite side of the support wall. Such a modular printer has been disclosed in U.S. patent application Ser. No. 09/965,533, filed Sep. 26, 2001, now U.S. Pat. No. 6,616,362, the contents of which is hereby incorporated herein by reference in its entirety.

Additionally, a further embodiment of the modular printer includes a modular rewind motor that is cooperative with the media take-up assembly. The rewind motor is capable of reversing the direction of travel of the print media or removing slack in the print media so as to adjust the amount of tension applied to the print media. Further still, the rewind motor and/or the drive motor assembly may be controlled by a programmable controller that applies varying amounts of current to the motor(s) as determined by the operation of the modular printer.

In another embodiment of the printer, the printhead assembly includes a camshaft having eccentric ends operatively coupled to latch arms. Rotation of the camshaft in a first direction urges the latch arms upward and towards the printhead. Continued rotation of the camshaft causes the latch arms to engage protruding edges of the printhead assembly and urge the printhead assembly towards the platen, thereby securing the printhead assembly to the platen with a substantially uniform amount of pressure. Rotation of the camshaft in a second direction disengages the latch arms from the edges and releases the printhead assembly from the platen.

It is envisioned that a switch may be located on the camshaft and is cooperative with a sensor to identify the position of the printhead relative to the platen. In addition, the modular printer may include a number of communication ports including serial, parallel, or USB. An additional port may include associated hardware and software that will communicate with a memory device using the secure digital input/output protocol. Further still, the modular printer may include a USB host for controlling attached USB peripheral devices (i.e. keyboards, mice, etc.).

The modular printer disclosed herein allows for easy access to each of the printer components for repair and/or maintenance. Moreover, the modular configuration facilitates printer upgrading, i.e., conversion from a thermal ink printer to a ribbon ink printer. Alternatively, the support block of the modular printer may include a removable vertical extension, thereby allowing the modular printer to accept alternate modular components and improving the adaptability of the modular printer.

BRIEF DESCRIPTION OF THE DRAWINGS

Various preferred embodiments of the presently disclosed printer are described herein with reference to the drawings wherein.

DETAILED DESCRIPTION OF PREFERRED EMBODIMENTS

Figure 1:
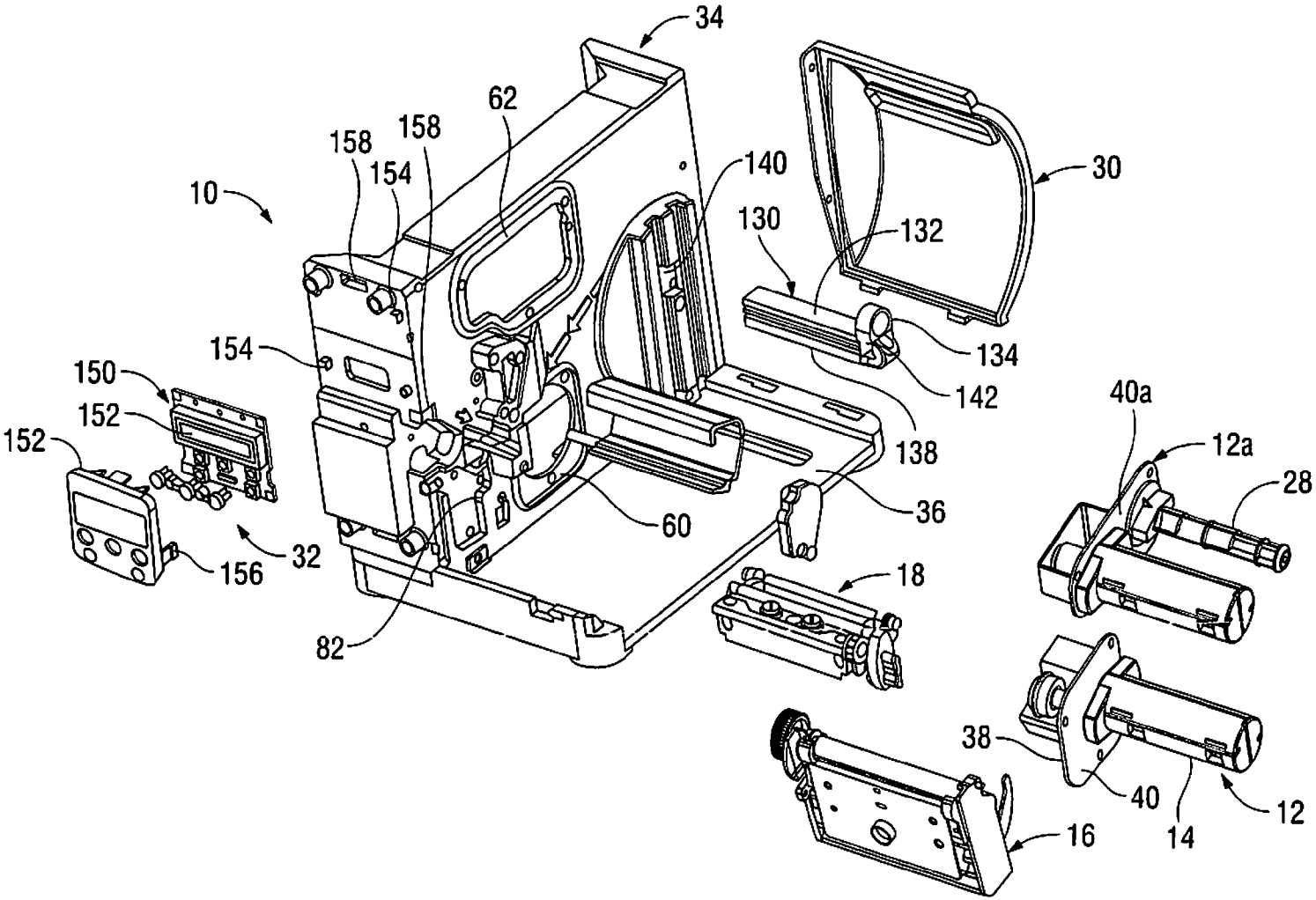
FIG. 1 is a perspective view with parts separated of one embodiment of the presently disclosed modular printer.

Preferred embodiments of the presently disclosed modular thermal printer will now be described in detail with reference to the drawings, in which like reference numerals designate identical or corresponding elements in each of the several views.

Figure 2:
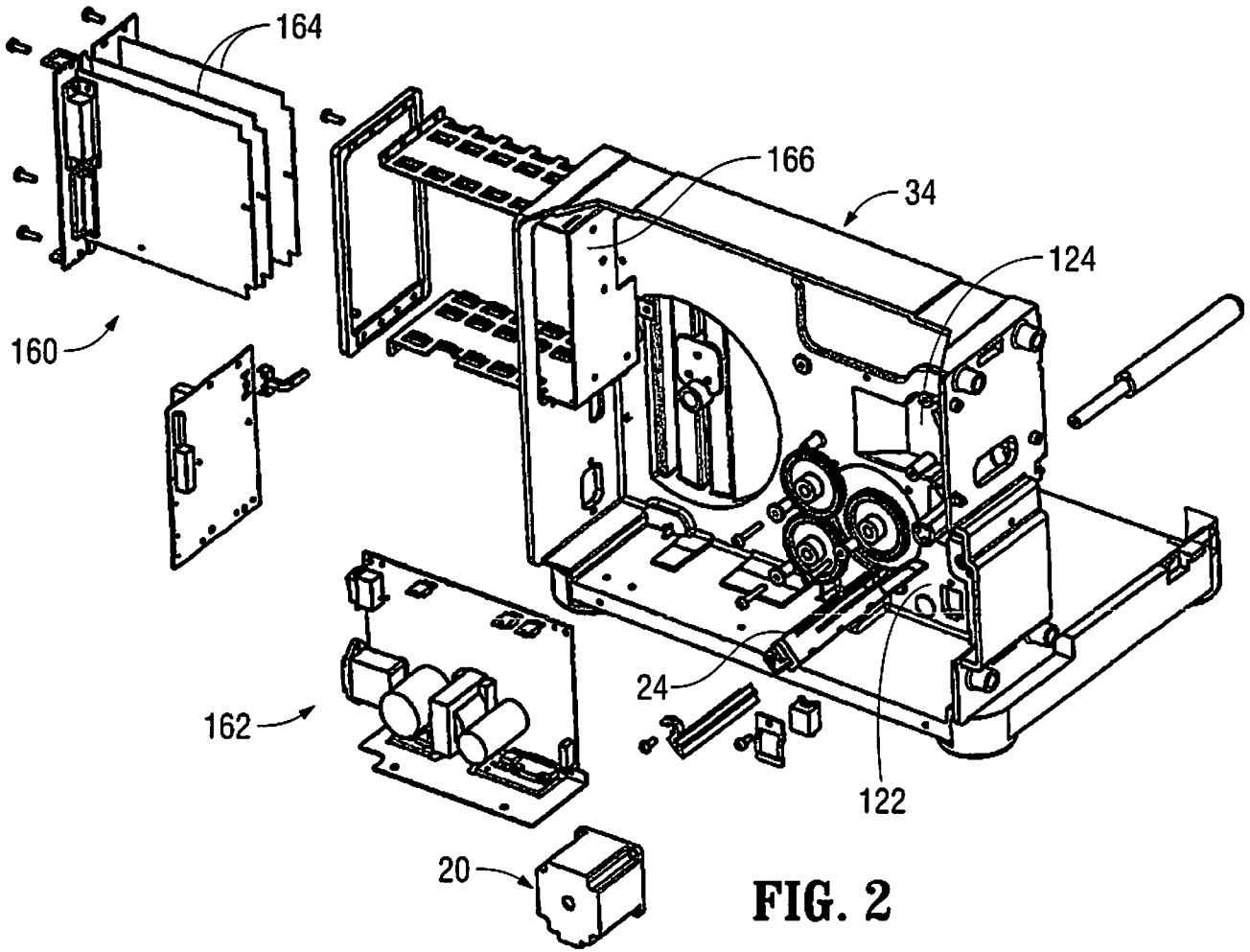
FIG. 2 is a perspective view with parts separated of the electrical and drive components of the modular printer shown in FIG. 1.

FIGS. 1 and 2 illustrate perspective views of the modular printer, with parts separated, shown generally as 10. More specifically, FIG. 1 illustrates the printing components of the modular printer and FIG. 2 illustrates the electrical and drive components of the modular printer.

Briefly, modular ink printer 10 includes a media take-up assembly 12 including a hub assembly 14 configured to support a media take-up roll (not shown), a support block assembly 16, a printhead assembly 18, a stepper motor assembly 20, a media sensor assembly 24, a cover assembly 30 and a display assembly 32. When printer 10 is operated as a ribbon ink printer, a ribbon supply assembly 28 may also be provided in conjunction with the media take-up assembly 12*a*. Each of the above-identified assemblies is removably supported on a support housing 34 having a plurality of recesses, which will be discussed in further detail below. The support housing defines an internal support wall of the modular printer and is configured for properly aligning each of the assemblies with respect to each of the other assemblies within the printer. Support housing 34 is preferably formed from a heat conductive material, such as an aluminum support housing, to facilitate the removal of heat from printer 10. However, other materials may also be used to form housing 34 including ceramics, plastics, sheet metal etc.

As discussed above, printer 10 has a display assembly 32. Display assembly 32 includes a module 150 having an LED display and a casing 152. Module 150 is positioned between diametrically opposed guide brackets 154 formed on support housing 34. Opposite corners of module 150 are subsequently secured to support housing 34 by screws. Casing 152 includes a plurality of flexible brackets 156 which can be snap fit to support housing 34 over module 150. Support housing 34 includes receiving structure 158 formed therein. Alternately, other known fastening devices may be used to secure module 150 and casing 152 to support housing 34.

Referring again to FIG. 2, the electrical and drive components of the ink printer 10 are secured to the opposite side of support housing 34 than are the printing components of the ink printer 10. As discussed above, stepper motor assembly 20 is secured to support housing 34 on the side opposite the printing components. Electronic circuitry 160 and electric drive assembly 162 to operate ink printer are secured to the support housing 34 on the side opposite the printing components. Electronic circuitry 160 is in the form of circuit boards 164, which can be installed in printer 10 by sliding the circuit boards through an opening 166, formed in support housing 34. The circuit boards can be chosen to suit the particular printing operation to be performed. For example, the circuitry 160 can be changed for different communications interfaces. Alternatively, software can be downloaded via a communications port to control a particular printing application.

Figure 3:
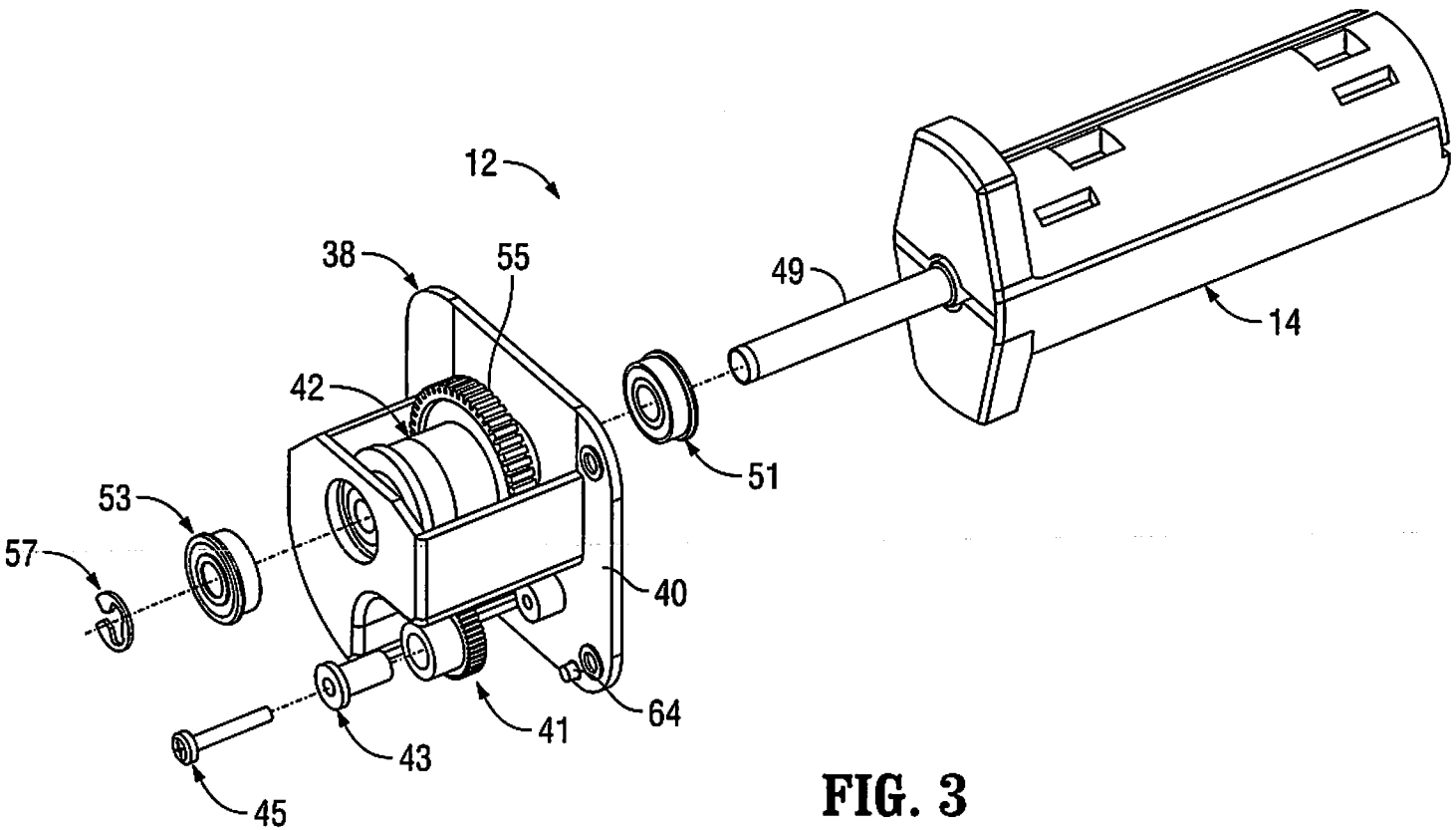
FIG. 3 is a perspective view with parts separated of the media take-up assembly of the modular printer shown in FIG. 1 when the printer is operated as a thermal ink printer.

Referring to FIG. 3, where printer 10 operated as a thermal ink printer, media take-up assembly 12 includes hub assembly 14, a housing 38 having a base plate 40 and a media clutch assembly 42 supported within housing 38. Media take-up assembly 12 also includes a gear 41, a post idler 43, and a screw 45 for securing gear 41 and post idler 43 to housing 38. First end 49 is supported by bearings 51 and 53. Bearing 51 is supported in driven gear 55 and bearing 53 is supported by housing 38. A lock ring 57 secures bearings 51 and 53, gear 55 and media clutch assembly 42 to shaft 46.

Figure 3A:
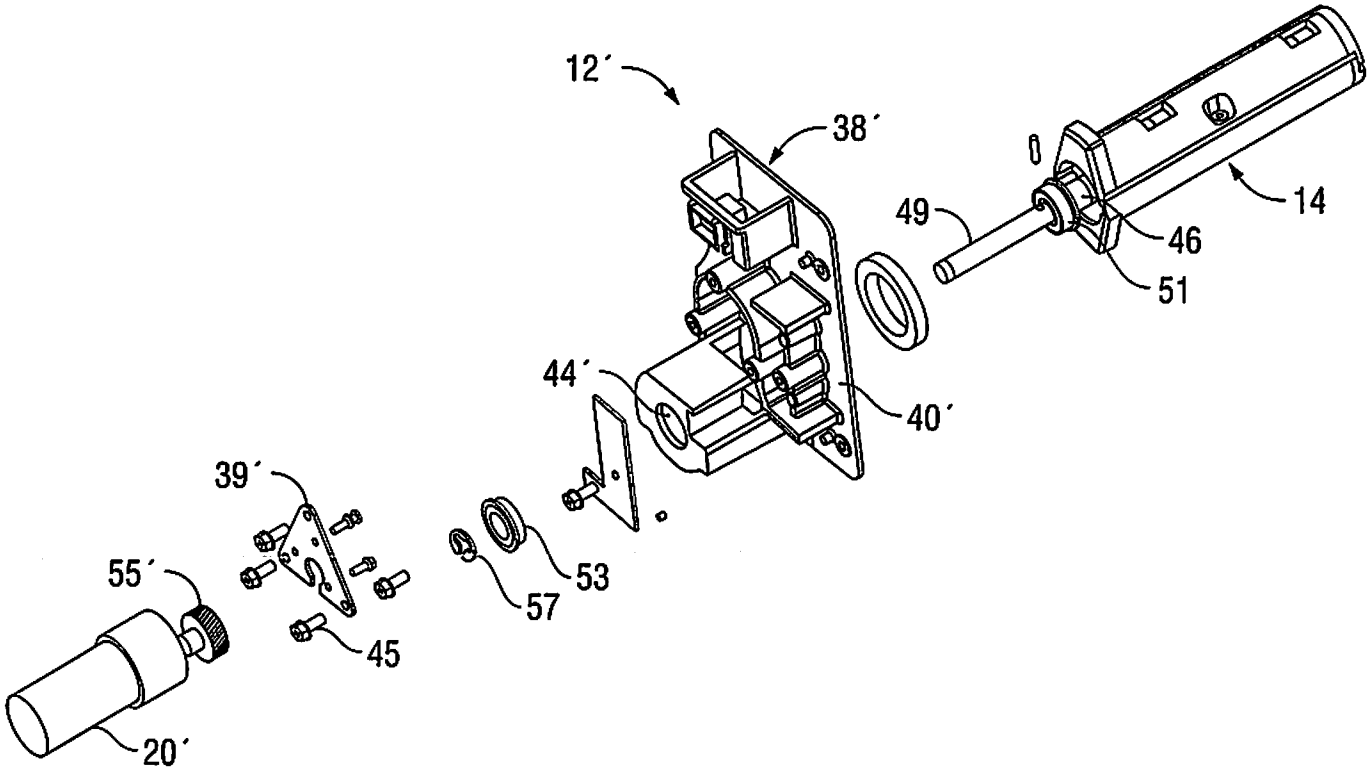
FIG. 3A is a perspective view, with parts separated, of an alternate embodiment of the media take-up assembly according to the present disclosure.
Figure 3B:
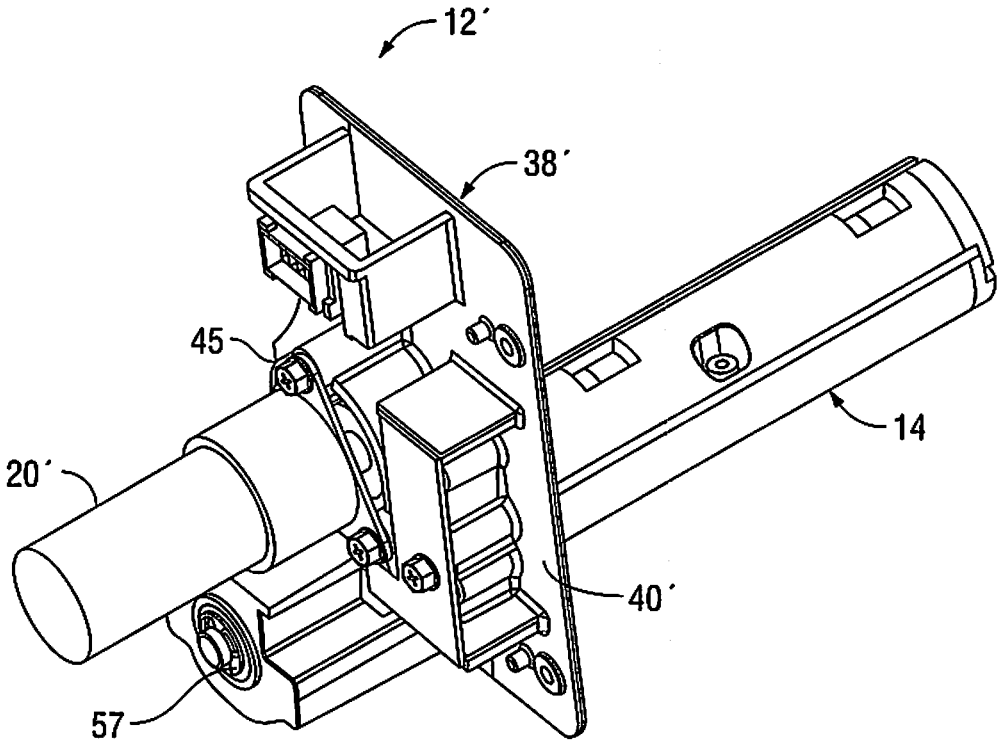
FIG. 3B is a perspective view of the media take-up assembly of FIG. 3A when assembled as a module.

In addition, an alternative embodiment of a media take-up assembly 12' is shown in FIGS. 3A and 3B. Media take-up assembly 12' includes hub assembly 14, a housing 38' with a base plate 40', and a rewind motor 20'. Media take-up assembly 14 is attached to base plate 40' using a screw 45. First end 49 is supported by bearings 51 and 53. Bearings 51 and 53 are supported by housing 38. Shaft 46 extends through opening 44'. A lock ring 57 secures bearings 51 and 53 to shaft 46 and further secures hub assembly 14 to housing 38'. Rewind motor 20' is operatively coupled to gear 55' and secured to housing 38' using plate 39' and screws 45. Rotation of rewind motor 20' results in rotational motion of gear 55' which is operatively coupled to hub assembly 14, thereby imparting rotational motion to shaft 46.

In particular, rewind motor 20' is controlled by pulse width modulation. When power is first applied to rewind motor 20', the DC voltage signal to rewind motor 20' is modulated such that a pulse width modulation of about 15% is achieved. Specifically, instead of supplying a substantially constant value of DC voltage to rewind motor 20', pulsed DC voltage is applied such that the applied DC pulses are about 15% of a maximum pulse width. Reducing the pulse width to about 15% occurs at initial power-up of rewind motor 20' or when rewind motor 20' is enabled to remove any slack in ribbon supply 60*a*. When rewind motor 20' is energized to remove slack in ribbon supply 60, it is de-energized after about 30 seconds. Thus, rewind motor 20' is adapted for rewinding the print media or removing slack in the print media during normal operations, thereby minimizing printing malfunctions.

After a print command is communicated to printer 10, the pulse width is determined using data including stepper motor assembly 20 print speed and applied to rewind motor 20' prior to applying a pulse width of about 15% of the maximum pulse width. The applied pulse width is maintained unless there is a change in speed. When the print speed of stepper motor assembly 20 varies, either higher or lower than the initial print speed, the pulse width is adjusted accordingly (i.e. a feedback response) such that the operational speed of rewind motor 20' maintains the desired amount of tension on the print media. During deceleration of stepper motor assembly 20 (i.e. when it is stopping), the pulse width of the DC voltage applied to rewind motor 20' is maintained until stepper motor assembly 20 is stopped. Further still, when stepper motor assembly 20 stops, the pulse width is maintained at a low setting, thereby tightening the print media. In addition, 30 seconds after stepper motor assembly 20 is stopped, rewind motor 20' is de-energized, thereby minimizing heat build-up.

In the rewind mode, rewind motor 20' is completely de-energized prior to being operated in the reverse direction, thereby minimizing jamming of the print media due to sudden changes in its direction of movement. A built-in timing circuit provides a window of time (i.e. settling time) between directions of rotation to minimize jamming of the print media. Rewind motor 20' may include a rotation counter (not shown) using a magnetic sensor and a field programmable gate-array (FPGA), as are known in the art. In addition, the inclusion of a FPGA reduces overhead on an associated microprocessor since the FPGA accumulates data related to the rotation of rewind motor 20' and eliminates interrupts or continuous monitoring of rewind motor 20' by the associated microprocessor. A set of software instructions (i.e. an algorithm) determines whether media take-up assembly 14 is approaching its maximum capacity for storing the print media by monitoring the rotation count of rewind motor 20' in combination with a distance traveled by the print media. Visual and/or audible warning indicia may be used to alert the operator that media take-up assembly 14 is nearing its capacity. If the diameter of the print media stored on media take-up assembly 14 reaches a specified value that may interfere with a printhead assembly 18 (FIG. 7), discussed in detail hereinbelow, an error condition occurs that may result in an automatic de-energization of rewind motor 20' to prevent damage to printer 10. Further still, the initial absence of rotation, does not indicate a problem (i.e. the print media is already tight), but an unexpected freeze of the counter is signaled as a problem with the rewinder.

Figure 1A:
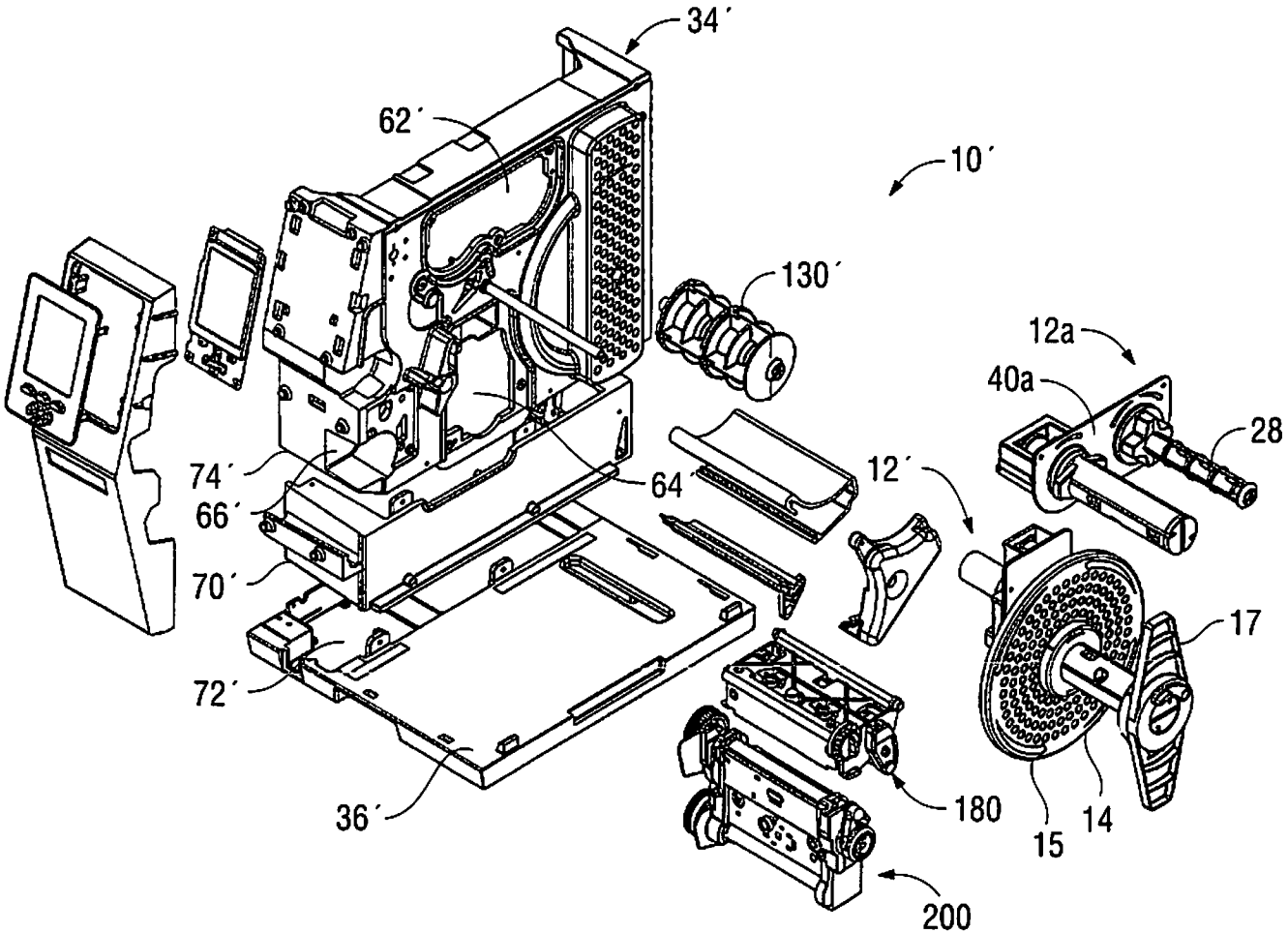
FIG. 1A is a perspective view, with parts separated, of an alternate embodiment of the presently disclosed modular printer.
Figure 2A:
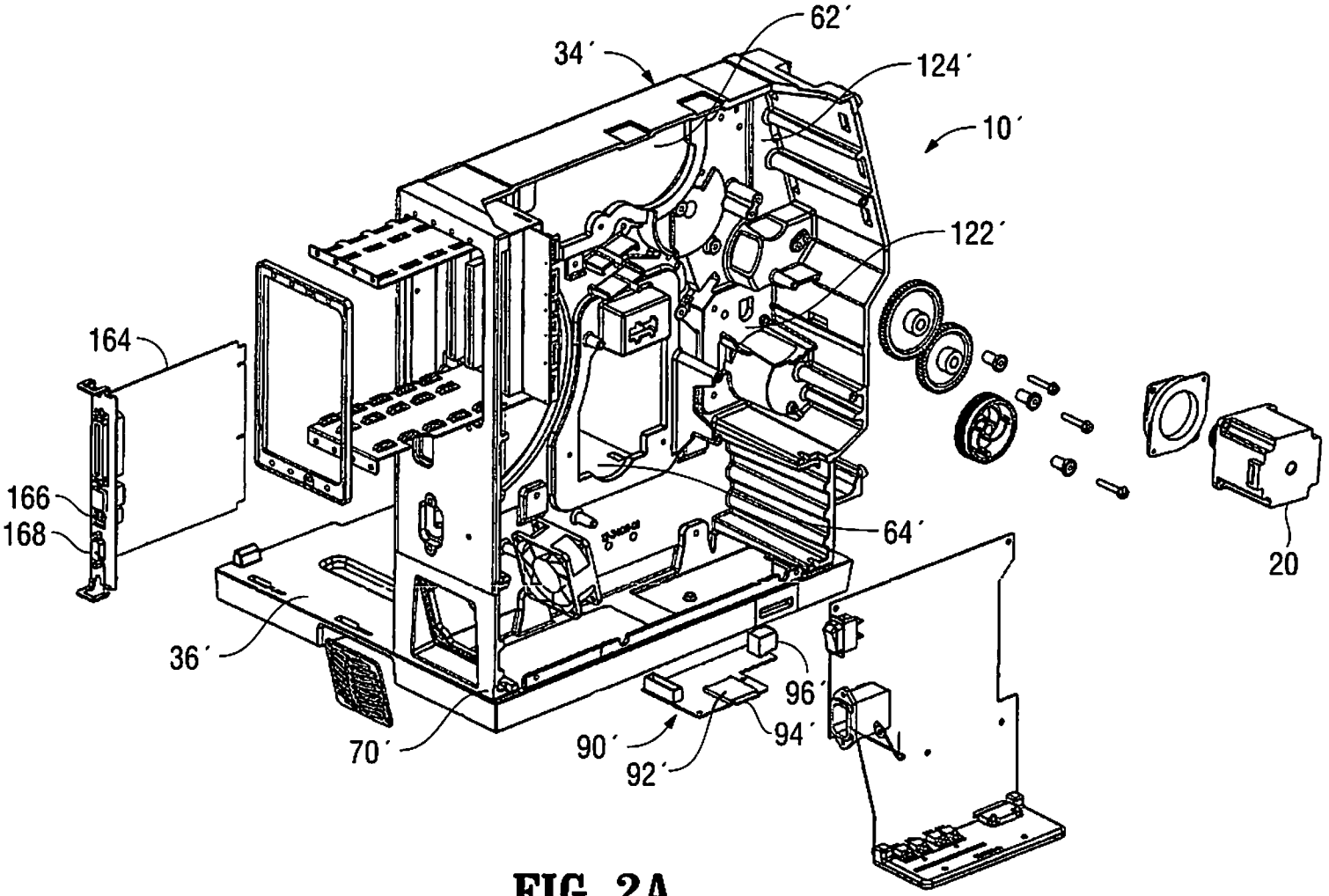
FIG. 2A is a perspective view, with parts separated, of the electrical and drive components of the modular printer of FIG. 1A.

Media take-up assembly 12' is attachable to and removable from an alternative embodiment of modular printer 10', as shown in FIGS. 1A and 2A. Referring initially to FIG. 1A, modular printer 10' includes a support body 34', a baseplate 36', stepper motor assembly 20, and an extension member 70'. Support body 34' includes recesses 62', 64', mounting locations 122', 124' (FIG. 2A), and a base 74'. Baseplate 36' includes a mounting bracket 72'. Extension member 70' is attachable to and removable from mounting bracket 72' and base 74', thereby allowing support body 34' to be selectively spaced apart from baseplate 36'. Extension member 70' is envisioned to be either 4", 6", or 8", although alternate height dimensions are contemplated. By including extension member 70', modular printer 10' is reconfigurable to accept a wider variety of assembly modules, thereby improving the flexibility and adaptability of modular printer 10'.

In addition, modular printer 10' includes media take-up assembly 12*a* or 12', printhead assembly 180, support bracket 200, and a media supply hub assembly 130'. Similar to modular printer 10, support body 34' is adapted such that assembly modules are attachable to and removable from support body 34' wherein support body 34' positions and aligns the assembly modules in an operational configuration. In this embodiment, either media take-up assembly module 12*a* or 12' may be installed in modular printer 10'. Media take-up assembly module 12' includes hub assembly 14, support disc 15, and retainer 17. In particular, support disc 15 is disposed on hub assembly 14 such that it is proximal to support body 34'. Retainer 17 is releasably attached to the opposing end of hub assembly 14, thereby allowing an operator to readily install and/or remove the print medium.

With reference to FIG. 2A, modular printer 10' further includes circuit board 164 having a universal serial bus (USB) port 166 and a serial port 168. USB port 166 communicates with attached external devices using the USB 1.0, 1.1, or 2.0 standards while serial port 168 communicates with attached external devices using the RS-232 or EIA-232 standard. In addition, modular printer 10' includes a circuit board 90' having a card slot 92' for receiving a secure digital input/output (SDIO) card 94' and a USB host controller (not shown) operatively coupled to a USB port 96'. USB port 96' in cooperation with the USB host controller allow modular printer 10' to control attached external USB devices as well as communicate with attached external devices using USB port 166.

Figure 4:
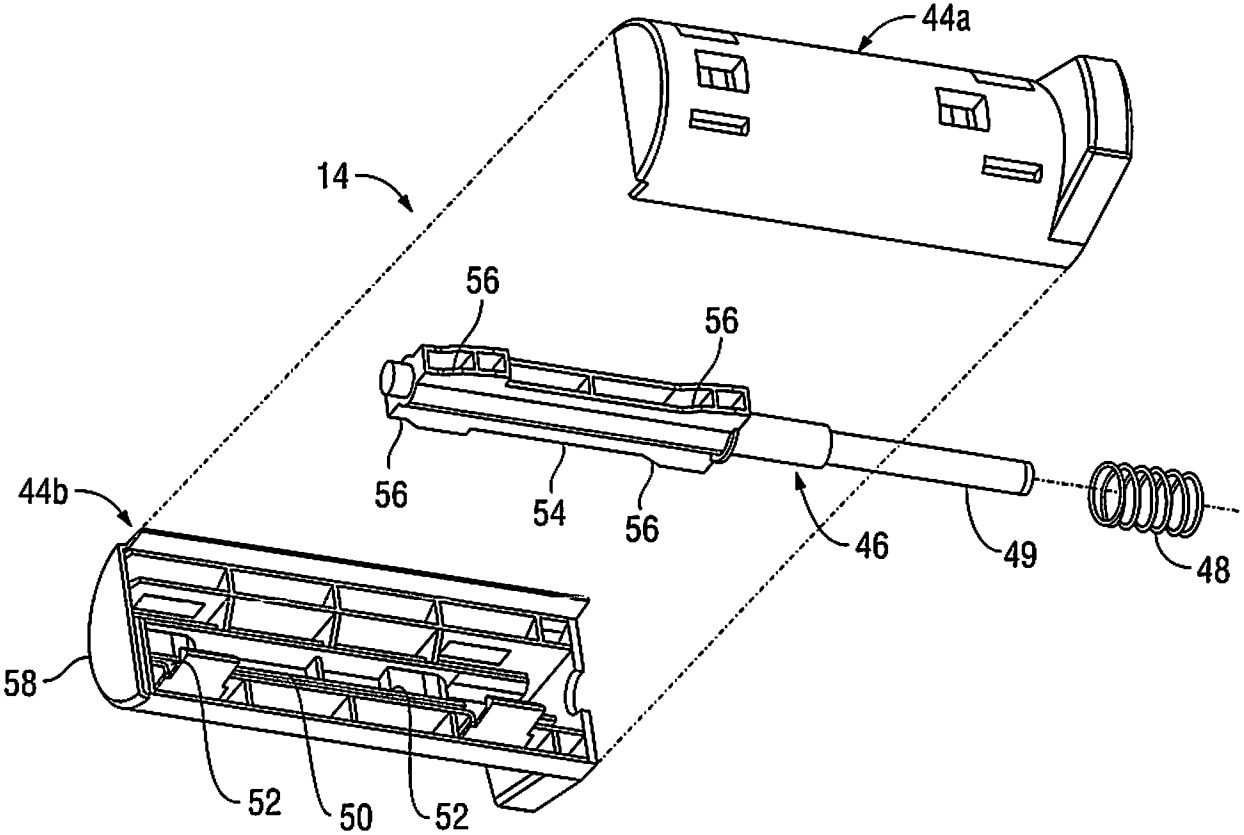
FIG. 4 is a perspective view with parts separated of the hub assembly of the media take-up assembly shown in FIG. 3.

Referring also to FIG. 4, hub assembly 14 includes a pair of molded housing half-sections 44*a* and 44*b*, which define hub assembly housing 44, a hub shaft 46 and a biasing member, which is preferably a coil spring 48. Hub shaft 46 includes a first end 49 having a reduced diameter, which extends outwardly from hub assembly housing 44.

Hub assembly housing half-sections 44*a* and 44*b* define a channel 50 having a pair of cam surfaces 52 formed therein. An engagement member 54 is secured to or formed monolithically with hub shaft 46. Each side of engagement member 54 includes a pair of abutment surfaces 56. Alternately, abutment surfaces may only be provided on one side of engagement member 54.

In the assembled state, engagement member 54 of hub shaft 46 is slidably positioned within channel 50 with coil spring 48 urging hub shaft 46 towards the distal end 58 of housing 44. Abutment surfaces 56 are positioned adjacent but distal of respective cam surfaces 52. When it is desired to remove a media take-up roll from and/or position a media take-up roll onto hub assembly 14, housing half-sections 44*a* and 44*b* are pulled outward to force cam surfaces 52 into engagement with abutment surfaces 56. Because surfaces 52 and 56 are angled towards distal end 58, compression of the housing half-sections urges hub shaft 46 against the bias of spring 48 away from distal end 58 of housing 44 allowing housing half-sections 44*a* and 44*b* to move towards each other to facilitate installation or removal of a media take-up roll onto or from hub assembly 14.

Referring again to FIGS. 1 and 3, the entire media take-up assembly 12 including hub assembly 14, housing 38 and media clutch assembly 42 forms an integral unit or module. Support housing 34 includes a plurality of reliefs formed on an internal wall of modular printer 10. One such relief 60 is configured to receive baseplate 40 of housing 38 and includes an alignment port 62 formed therein dimensioned to receive an alignment protrusion 64 formed on baseplate 40 to ensure proper positioning of media take-up assembly 12 on support housing 34. Only three screws are required to secure the entire media take-up assembly 12 to support housing 34, thus the entire assembly or module can be easily removed from or installed within printer 10.

Figure 5:
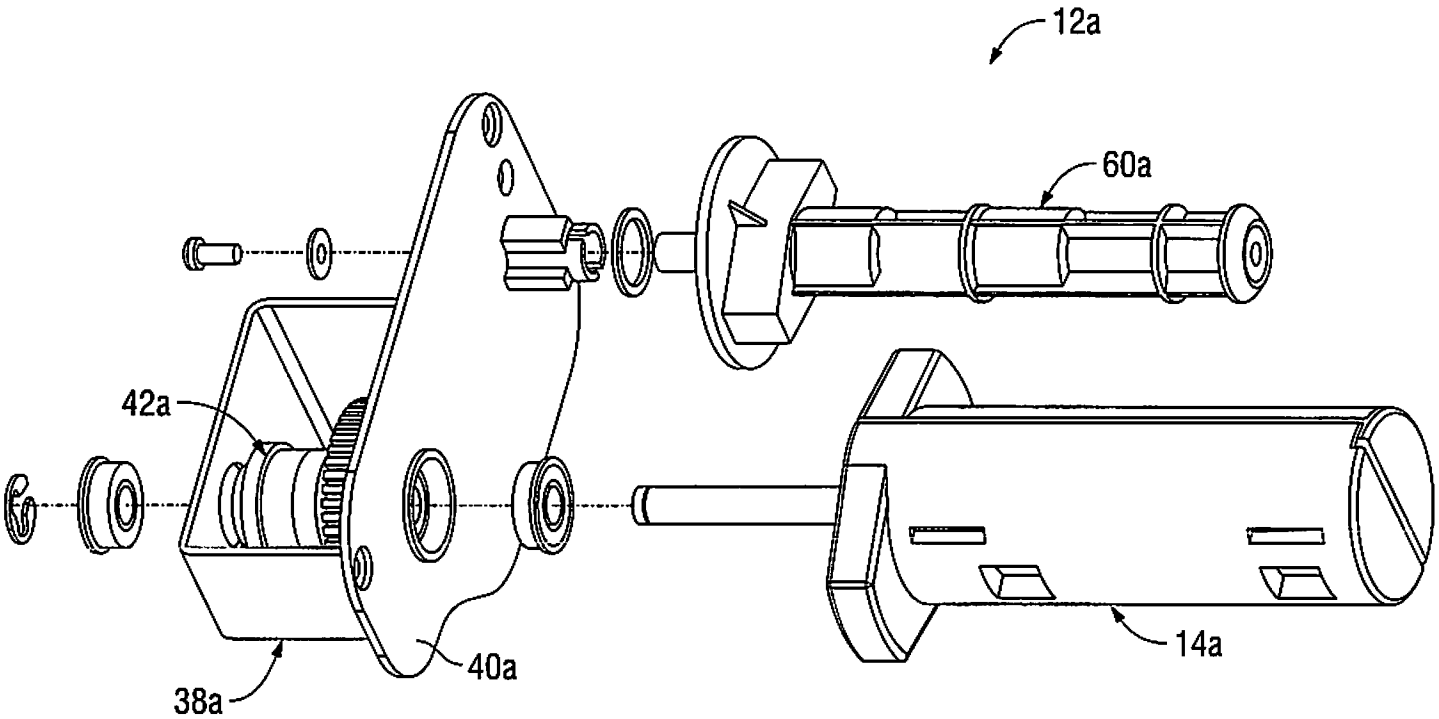
FIG. 5 is a perspective view of the ribbon take-up assembly of the modular printer shown in FIG. 1 when the printer is operated as an ink ribbon printer.

Referring to FIG. 5, where printer 10 is operated as an ink ribbon printer, a second media take-up assembly 12*a* is provided which in addition to hub assembly 14*a*, housing 38*a* including baseplate 40*a*, and media clutch assembly 42*a*, includes a ribbon supply shaft 60*a*. Ribbon supply shaft 60*a* is also secured to baseplate 38*a* such that the media take-up assembly 12*a* forms an integral unit or module.

Referring again to FIGS. 1 and 5, a relief 62 configured to receive baseplate 40*a* is formed in support housing 34. As discussed above with respect to relief 60, an alignment port (not shown) is formed in relief 62 to ensure proper positioning of media take-up assembly 12*a* within relief 62. Baseplate 40*a* can be secured to support housing 34 using three screws, thus facilitating fast and easy removal and/or installation of media take-up assembly 12*a* within printer 10.

Since printer 10 can only be operated as either a thermal ink printer or an ink ribbon printer, either or both of media take-up assemblies 12 or 12*a* will be secured to support housing 34 at a time. However, the printer 10 can be easily and quickly converted from a thermal ink printer to a ribbon ink printer and vice-versa by substituting one media take-up assembly or module for the other. The relief configured to receive the baseplate of the media take-up assembly not in use should be covered by a blank (not shown), which is preferably constructed of the material used to form support housing 34.

Figure 6:
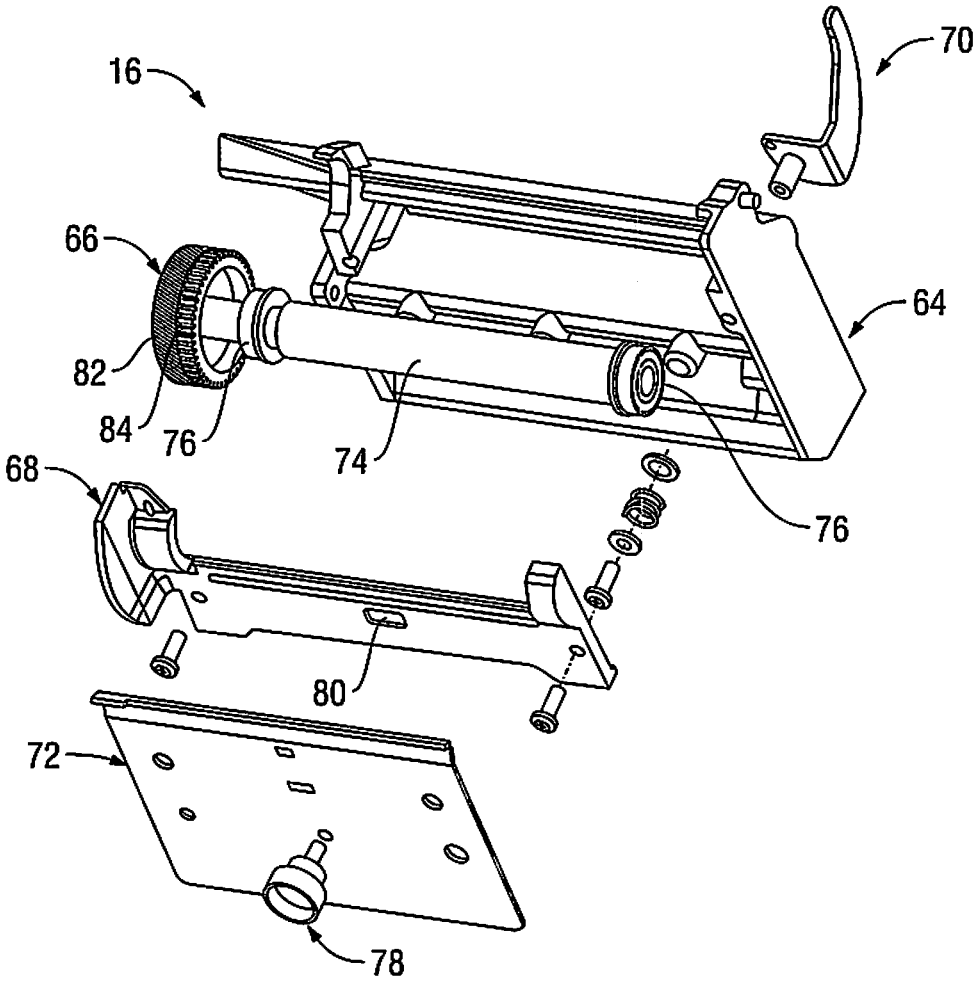
FIG. 6 is a perspective view with parts separated of the support block assembly of the modular printer shown in FIG. 1.

Referring to FIGS. 1 and 6, support block assembly 16 includes platen mounting block 64, a platen assembly 66, a retainer bracket 68, a media guide 70, and a tear bar 72. Platen assembly 66 includes platen 74 having a shaft (not shown) rotatably supported on mounting block 64. A flanged bearing 76 is secured to each end of the platen shaft. The bearings are positioned within recesses (not shown) formed in mounting block 64 to facilitate rotation of platen 74 relative to mounting block 64. A pair of driven gears 82 and 84 are secured to one end of the platen shaft and are independently engageable by a drive gear (which will be discussed below) to drive the platen 74. Retainer bracket 68 is secured to mounting block 64 via a pair of screws to retain bearings 76 within the recesses of mounting block 64. Tear bar 72 is secured to mounting block 64 by a screw 78 which extends through an opening 80 defined by retainer bracket 68.

It is noted that in printers found in the prior art, removal of a damaged platen is a difficult, time-consuming procedure. In contrast, all that is required to remove platen 74 from support block assembly 16 is to unscrew screw 78 from mounting block 64 to remove tear bar 72 from assembly 16, and to remove the two screws securing retainer bracket 68 to mounting block 64. Platen 68 can now be lifted from mounting block 64.

As discussed above with respect to media take-up assembly 12, the entire support block assembly 16 forms an integral unit or module which is secured within a relief 82 (FIG. 1) formed in support housing 34. Support block assembly or module 16 can be easily and quickly removed and/or installed by removing or inserting a pair of screws (not shown) which extend between mounting block 64 and support housing 34. Mounting block 64 also includes an alignment protrusion (not shown) configured to be received within an alignment port formed in support housing 34 to ensure proper positioning of support block assembly or module 16 in relation to support housing 34.

In an alternative embodiment, printer 10 (FIG. 1) includes modular components for accommodating print media having different widths. In particular, printer 10 includes a baseplate 36 that is modular and readily replaced by a baseplate having a different width that is proportional to the width of the installed print media. In addition, media take-up assembly 12, support block assembly 16, printhead assembly 18, and ribbon supply assembly 28 are modular components having different widths to accommodate the different print media. The above-disclosed modular components are configured for accepting print media having widths of 4", 6", or 8". When changing the width of the print media, baseplate 36, media take-up assembly 12, support block assembly 16, printhead assembly 18, and ribbon supply assembly 28 are selected such that their width matches the width of the selected print media. By providing these modular components, printer 10 is adaptable and accommodates a variety of print media widths. It is envisioned that other print media sizes may be installed in printer 10 and that baseplate 36, media take-up assembly 12, support block assembly 16, printhead assembly 18, and ribbon supply assembly 28 are dimensioned accordingly.

Figure 7:
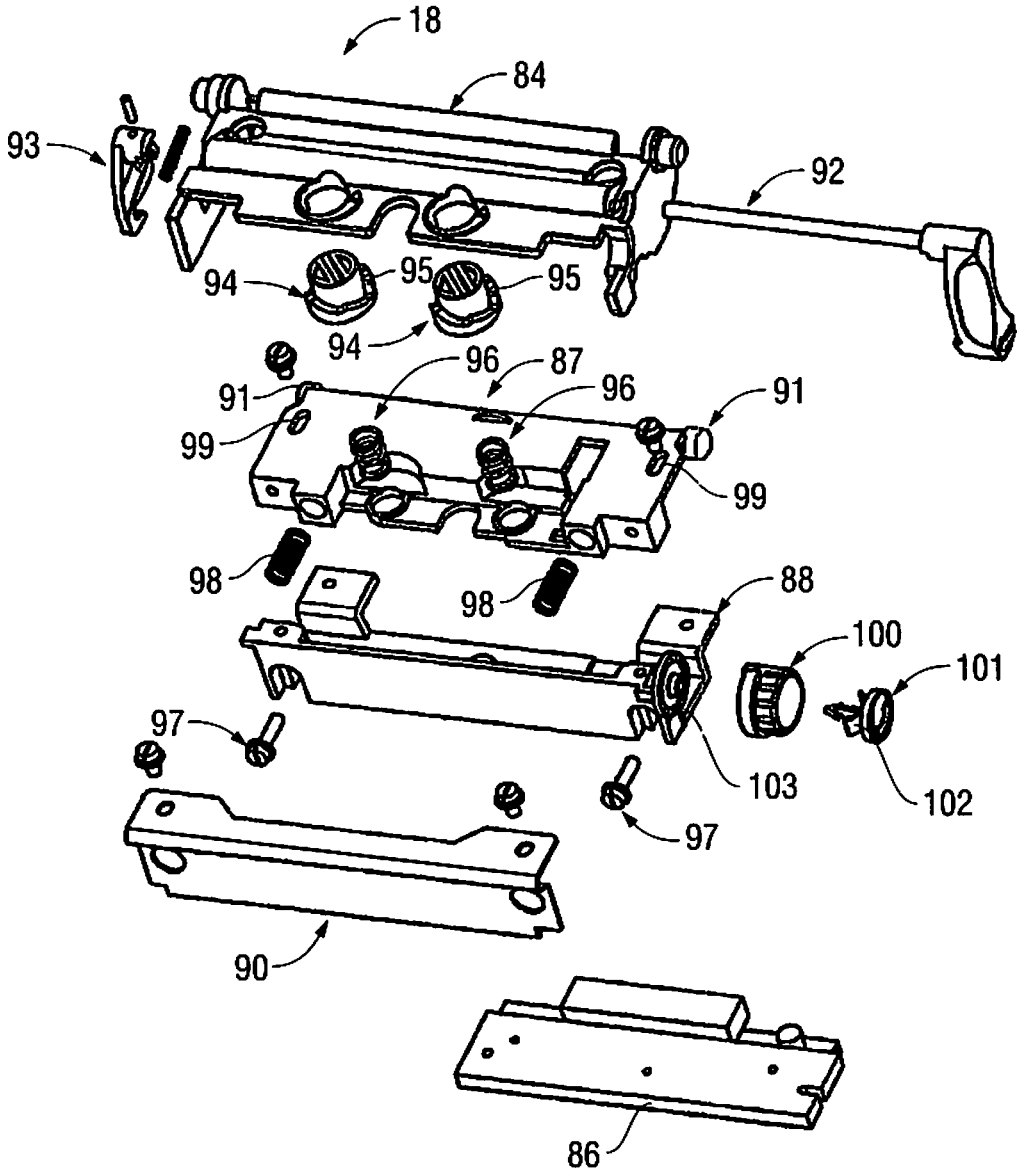
FIG. 7 is a perspective view with parts separated of the printhead assembly of the modular printer shown in FIG. 1.

Referring to FIG. 7, printhead assembly 18 includes a printhead mount 88, a printhead 86, a printhead adjustment bracket 87, and a ribbon shield 90. Printhead 86 includes a pair of pivot members 91, which are pivotably secured to printhead pivot 84. A latch assembly including latch members 92 and 93 is supported on printhead pivot 84 and is movable into a position to retain printhead 86 and printhead assembly 18 in fixed rotatable relation. A rotatable knob 94 having a cam surface 95 formed thereon is supported on each side of printhead 86. The cam surface 95 of each knob 94 is urged into engagement with printhead mount 84 by a spring 96. Both knobs 94 are selectively rotatable to urge printhead 86 away from printhead mount 84 to control printhead pressure of the printhead 86.

Printhead adjustment bracket 88 is secured to printhead adjustment bracket 87 by screws 97 which are positioned within slots 99 formed in printhead adjustment bracket 87. A pair of springs 98 is positioned between bracket 88 and printhead adjustment bracket 87 to urge bracket 88 away from printhead adjustment bracket 87. An adjustment knob 100 having a cam surface positioned to engage printhead 86 is rotatably secured to bracket 88 by a fastener 101 having a biasing member 102 formed therewith. Adjustment knob 100 includes a protrusion (not shown) which is urged into engagement with an annular array of detents 103 by fastener 101. Adjustment knob 100 is rotatable to selectively cam bracket 88 towards printhead 86 against the bias of springs 96. The adjustment knob protrusion and the annular array of detents 103 function to retain the bracket 88 and printhead 86 at fixed positions in relation to each other as determined by the rotational position of adjustment knob 100.

Referring again to FIGS. 1 and 7, the printhead assembly 18 forms an integral unit or module which is bolted to support housing 34 to secure the assembly within the printer.

Figure 7A:
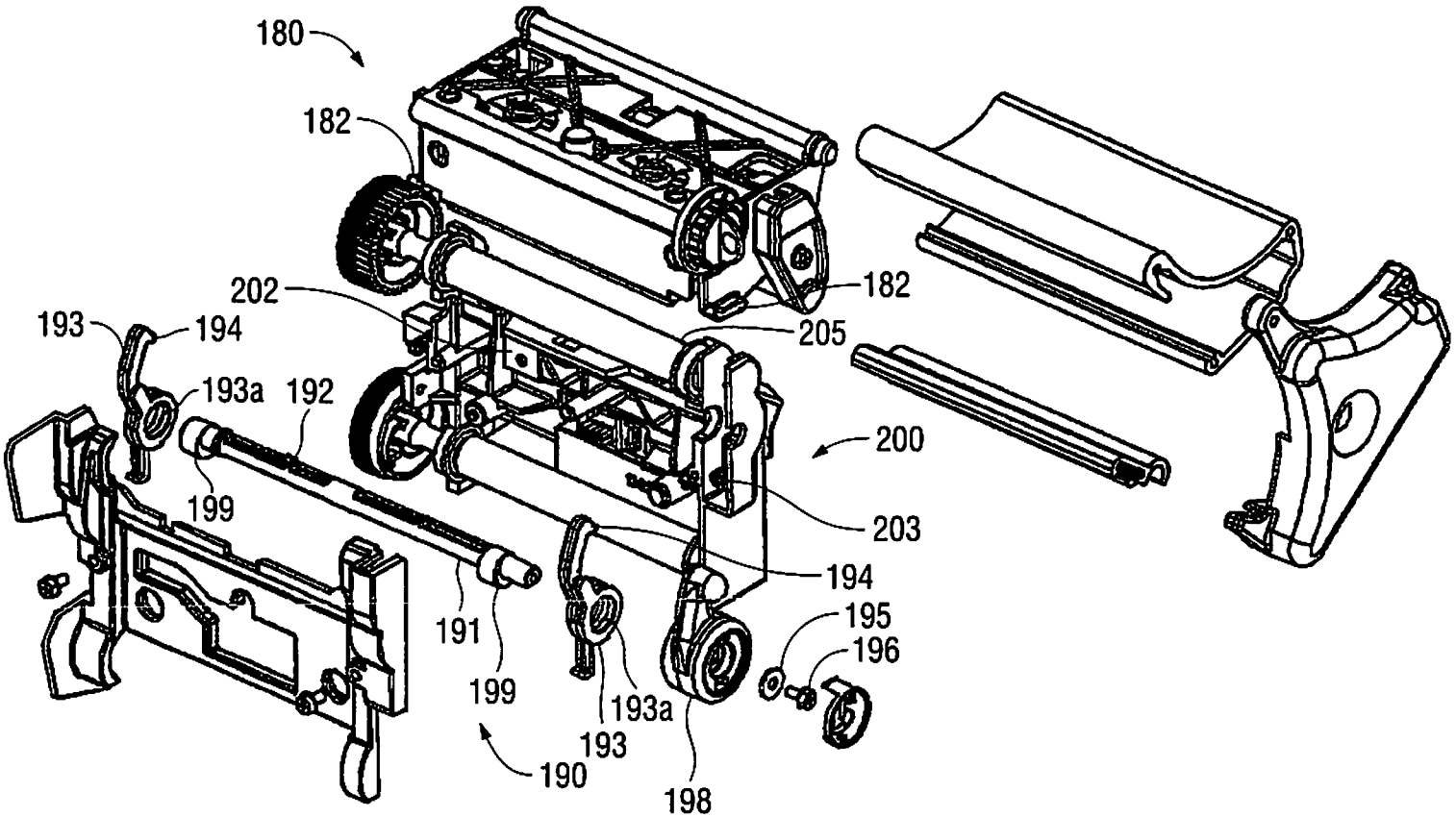
FIG. 7A is a perspective view, with parts separated, of an alternate embodiment of a printhead assembly.
Figure 7B:
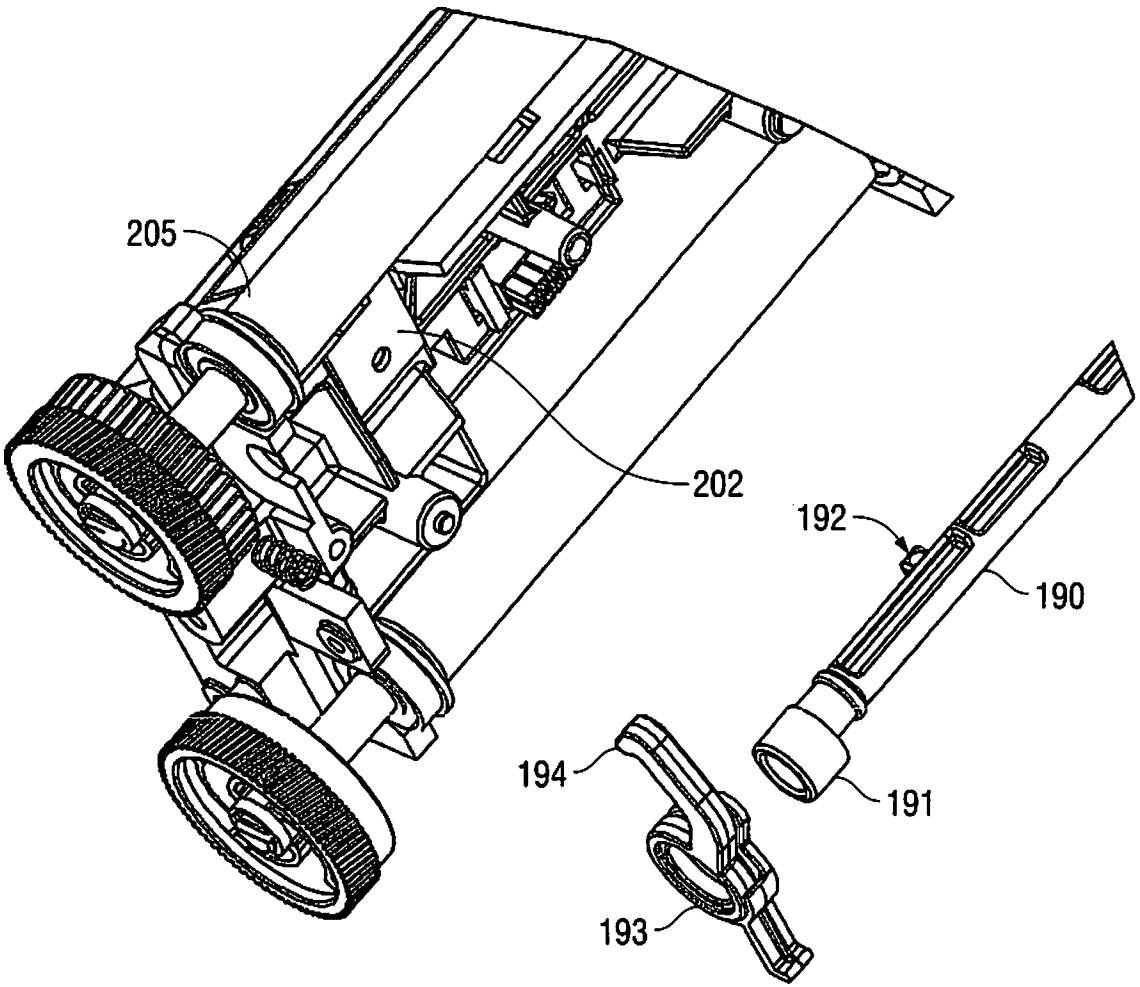
FIG. 7B is a perspective view of a portion of the printhead assembly of FIG. 7A that is enlarged to illustrate a magnetic switch and a sensor.
Figure 7C:
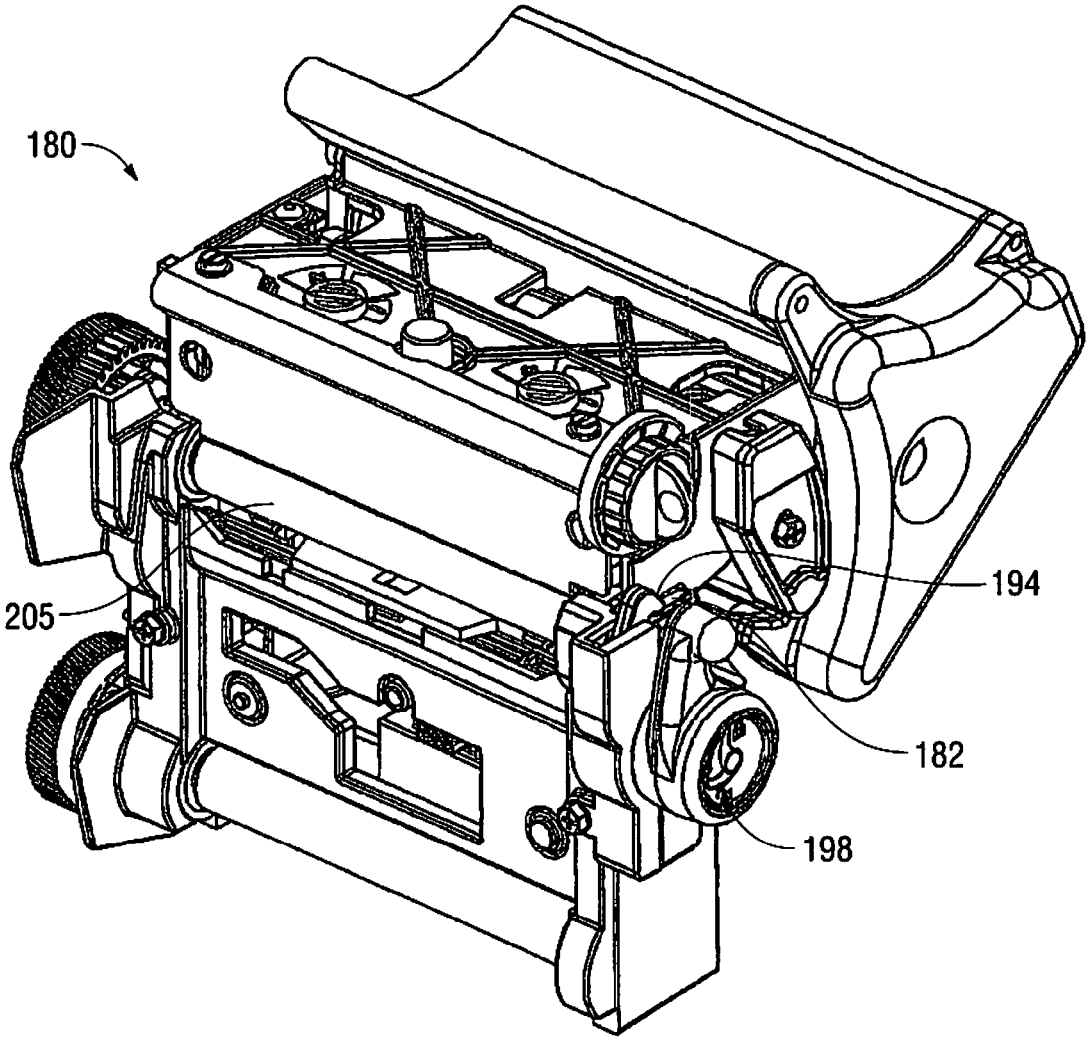
FIG. 7C is a perspective view of the assembled printhead assembly of FIG. 7A.

Referring now to FIGS. 7A-C, an alternate embodiment of a printhead assembly 180 is illustrated. Printhead assembly 180 includes a printhead mount, a printhead adjustment bracket, and a ribbon shield that are substantially similar to the corresponding components previously discussed with respect to printhead assembly 18. A pair of edges 182 extends outwards from printhead assembly 180. A support bracket 200 is associated with printhead assembly 180 and includes a sensor board 202, springs 203, and platen 205. The print media is transported along a path that is defined between the printhead of printhead assembly 180 and platen 205. A latch assembly 190 includes a camshaft 191, latch arms 193 having fingers 194, and a latch handle 198. Latch handle 198 is attached to camshaft 191 using a threaded fastener 196 in combination with a washer 195. In particular, camshaft 191 has a switch 192 disposed thereon and eccentric lobes 199 that are located at opposing ends of camshaft 191. Openings 193*a* of latch arms 193 engage lobes 199 such that rotation of camshaft 191 in a first direction, using latch handle 198, urges fingers 194 upwards and towards edges 182. After a predetermined amount of rotation, fingers 194 engage edges 182 such that rotation of camshaft 191 in a second (i.e. opposite) direction urges fingers 194 downward thereby repositioning printhead assembly 180 in proximity to platen 205. By providing a pair of latch arms 193, the pressure applied to platen 205 by printhead assembly 180 is substantially uniform across a width of platen 205.

Switch 192 (FIG. 7B) is a magnetic switch that cooperates with sensor board 202 (FIG. 7B). When switch 192 is positioned in proximity to sensor board 202, a signal is generated and communicated to a controller (not shown) that indicates that printhead assembly 180 is located in proximity to platen 205 (i.e. printhead assembly is closed and ready to print). Otherwise, switch 192 and sensor board communicate to the controller that printhead assembly 180 is open. Other types of switches, as are known in the art, may be used in lieu of a magnetic switch. Further still, switch 192 synchronizes with a top of form (TOF) sensor. When switch 192 and sensor board 202 indicate that printhead assembly is in proximity to platen 205 (i.e. closed), the TOF sensor operates in either the label sense mode. Otherwise, the TOF sensor operates in the media loading mode. An example of a suitable TOF sensor is disclosed in U.S. patent application Ser. No. 10/962,117, filed Oct. 8, 2004, currently assigned to Datamax Corp., the entire contents of which are hereby incorporated by reference.

Figure 8:
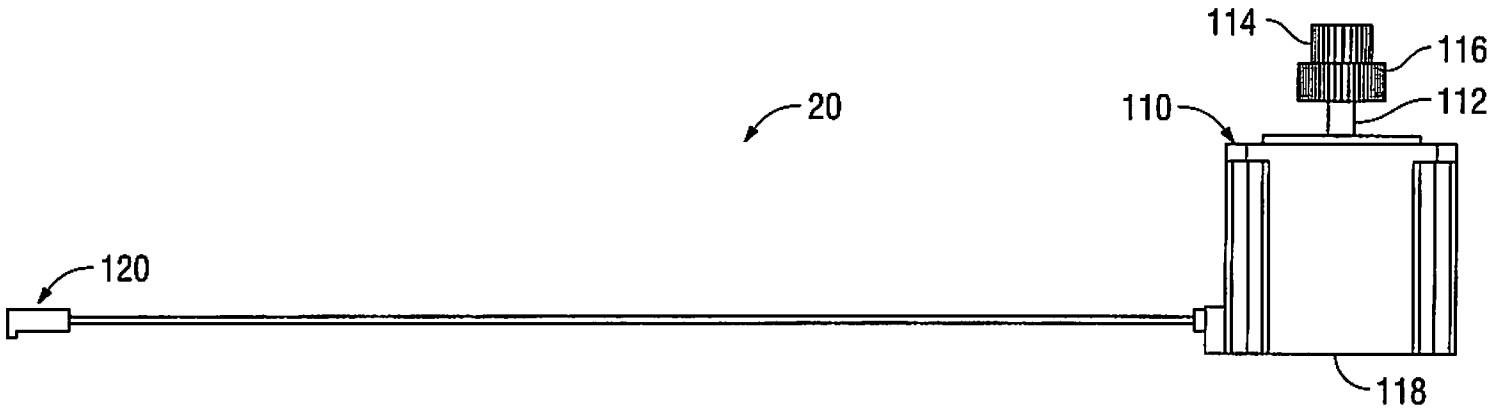
FIG. 8 is a top view of the stepper motor assembly of the modular printer shown in FIG. 1.

Referring to FIG. 8, stepper motor assembly 20 includes a stepper motor 110 having an output shaft 112 and a pair of gears 114 and 116 secured to output shaft 112. Stepper motor 110 is supported within a housing 118. A connector 120 having a contact pin (not shown) extends from housing 118 to facilitate connection of the stepper motor to a power source. Stepper motor assembly 20 forms an integral unit or module.

In a further embodiment of the present disclosure, stepper motor assembly 20 is a current controlled stepper motor. Different current levels are applied to either stepper motor assembly 20 such that the amount of applied current corresponds to the motor's mode of operation. A controller (not shown) selects the amount of current required for a selected mode of operation and adjusts the applied current to the motor. Examples of these modes of operation include, but are not limited to, acceleration, steady state, deceleration, and idle. By providing the amount of current required for operating either stepper motor assembly 20, the operating temperature of the motor is reduced, thereby improving the operating life of the motor, reducing the amount of heat generated by the motor, and reducing the energy consumed by printer 10. In contrast, motors using a fixed current source require sufficient current to operate at their fastest speed which is greater than the current required at lower speeds, thereby increasing motor temperatures, shortening motor life, and increasing energy consumption.

A programmable motor controller (not shown) is included for selecting the amount of current to be provided to stepper motor assembly 20. In one embodiment, the programmable motor controller includes four programmable modes: acceleration, steady state, deceleration, and idle. In the idle mode, the applied current is about 15% of a maximum current value where only one active phase is needed to keep stepper motor assembly 20 locked in place while idle and waiting for a job. When the programmable motor controller selects the acceleration mode, the maximum current value is applied to stepper motor assembly 20. This value of current is determined using the maximum value of motor torque and system load. When stepper motor assembly 20 reaches its target speed, the applied current is reduced to about 30% below the maximum current value to maintain its speed. The current level is determined by the steady state load of printer 10. In the deceleration mode, the applied current is used for stopping stepper motor assembly 20 completely. Once stepper motor assembly 20 is stopped, the programmable motor controller switches to the idle mode and applies idle current to stepper motor assembly 20. Deceleration time is typically very short, therefore steady state current can be used instead in order to simplify the design. In case there is a positive speed change, the maximum ramping current is applied until the new steady state is reached again.

Referring also to FIG. 2, cast 34 includes first and second mounting locations 122 and 124 configured to receive motor assembly 20. Motor assembly 20 can be secured at either location to selectively position either one of gears 112 or 114 into meshing engagement with one of platen assembly gears 82 or 84 (See FIG. 6). This double gear multi-location mounting arrangement provides for a printer which is capable of changing speed simply by changing the location of the stepper motor on support housing 34. Moreover, since only four screws need be removed, this process can be performed easily and quickly.

Referring again to FIG. 1, printer assembly 10 also includes a media supply hub assembly 130 which includes a hub 132 and an adjustable retaining member 134. Hub 132 includes an elongated slot 138 formed in each side thereof. Adjustable retaining member 134 includes a body 140 having a pair of legs 142. Each leg 142 has a distal end portion (not shown) which is configured to be slidably received in elongated slot 138. When retaining member 134 is advanced to the distal end of slot 138, the slot configuration changes to permit the retaining member 134 to be pivoted from a position perpendicular to hub 132 to a position parallel thereto. In the parallel position, a media supply roll can be positioned on hub 132. After the media supply roll (not shown) is positioned on hub 132, retaining member 134 can be pivoted back to a position perpendicular to hub 132 and slid into contact with the media supply roll to retain the media supply roll on hub 132. The force on retaining member 134 by the media supply roll locks retaining member 134 in position on hub 132. Because retaining member 134 is slidable within slot 138 along the length of hub 132, multiple size media supply rolls can be securely held on hub 132 by retaining member 134. Preferably, hub 132 is constructed from cast aluminum and retaining member 134 is constructed from a reinforced plastic. Alternately, other materials of construction may be used for each of the parts including engineering metal, plastics, ceramics, etc. The media supply assembly 130 can be secured within relief 140 in cast 34 using screws. As described above, relief 140 ensures proper alignment of media supply assembly 130 in relation to the other components of the printer 10.

Figure 9:
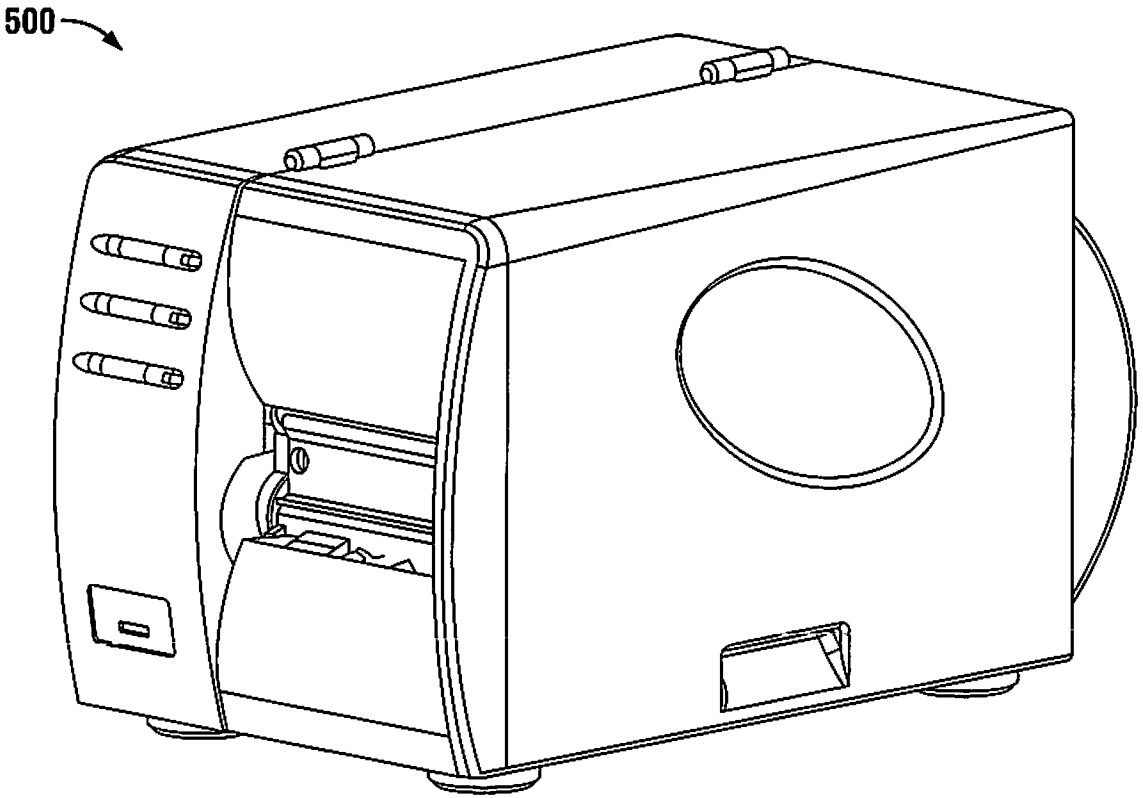
FIG. 9 is a perspective view of another preferred embodiment of the presently disclosed modular printer.
Figure 10:
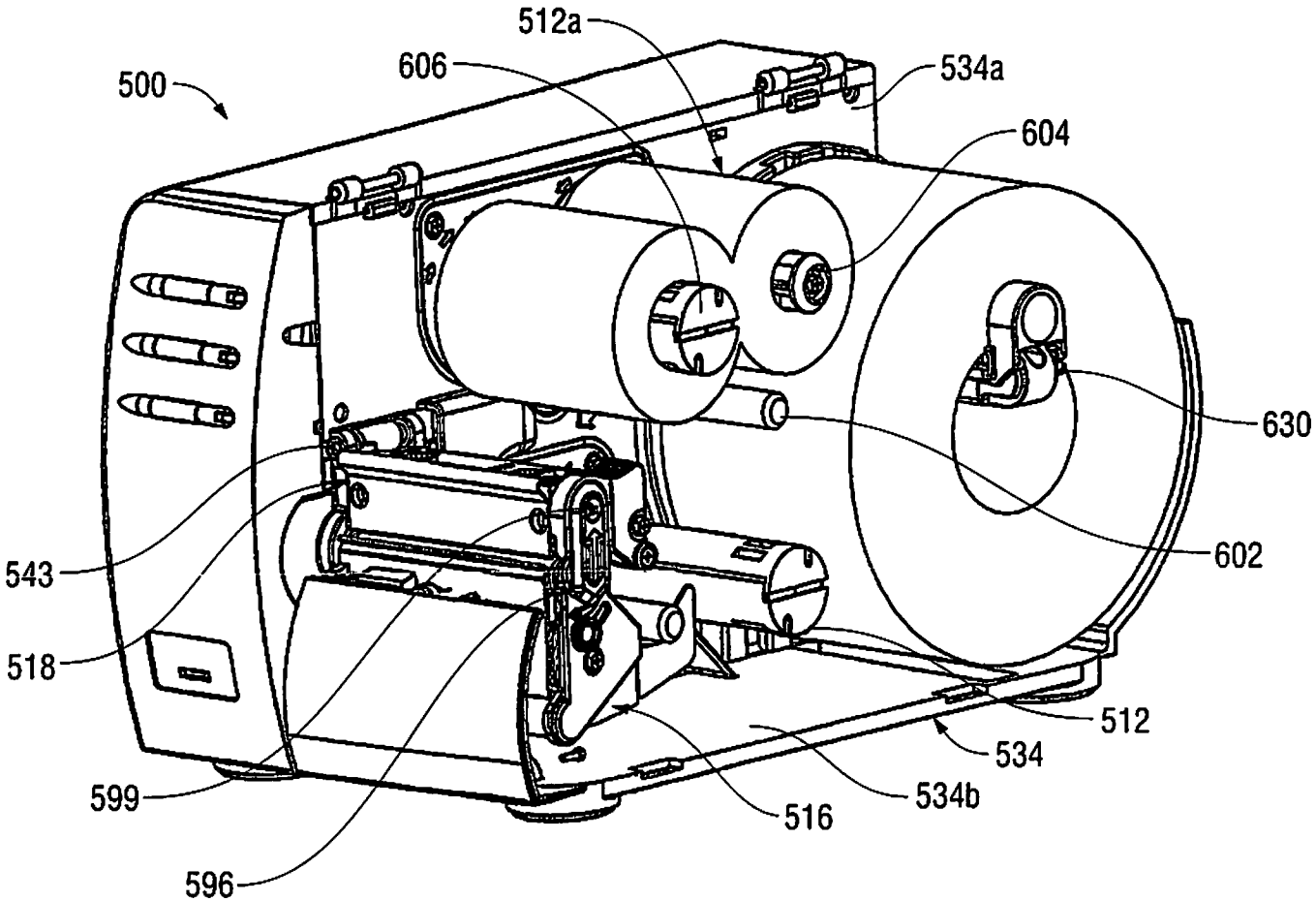
FIG. 10 is a perspective view of the modular printer shown in FIG. 9 with a first half of the outer cover removed.
Figure 11:
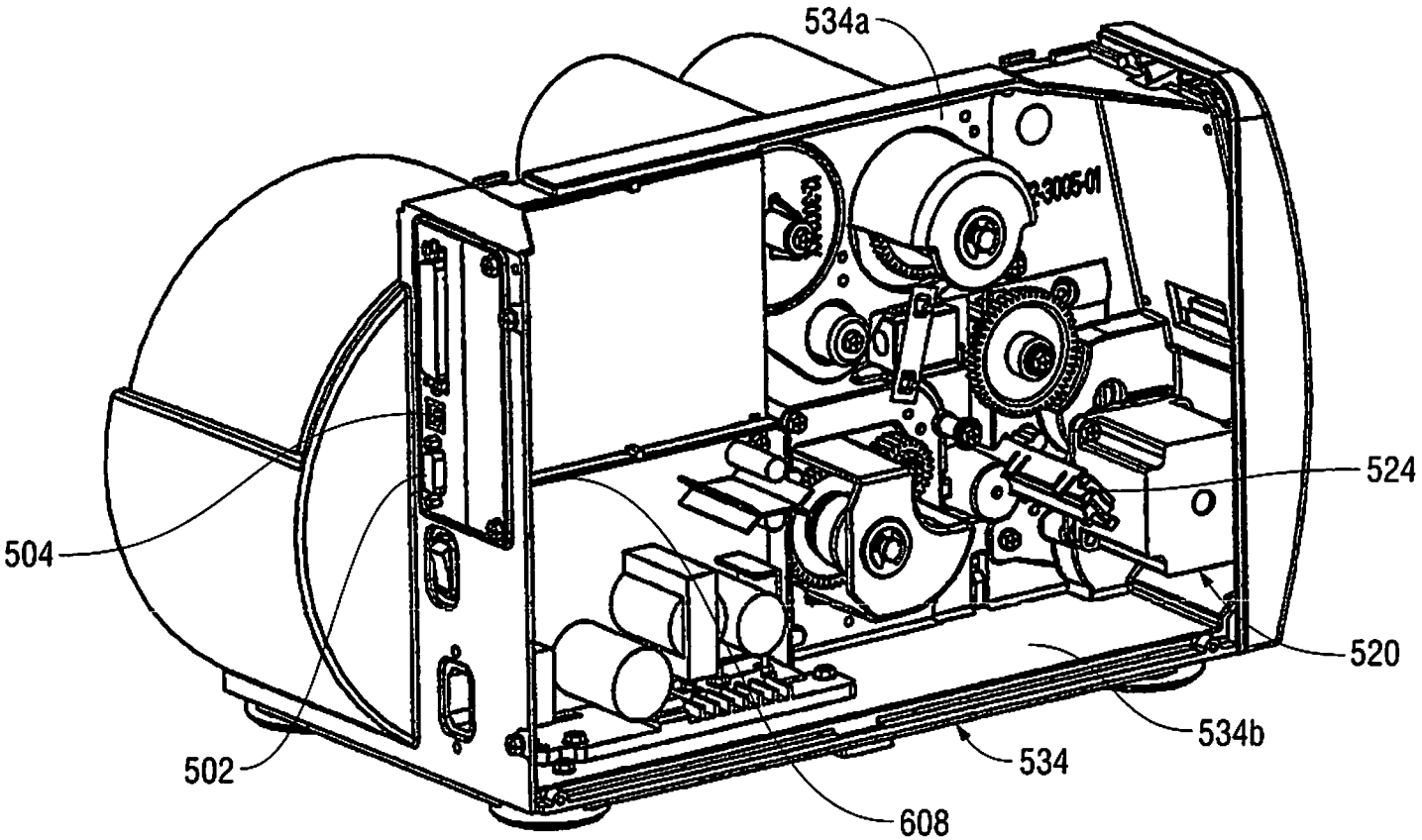
FIG. 11 is a perspective view of the modular printer shown in FIG. 1 with a second half of the cover removed.

FIGS. 9-11 illustrate another preferred embodiment of the presently disclosed modular printer shown generally as 500. Modular printer 500 includes a support body or casting 534. Unlike casting 34 of modular printer 10, casting 534 includes a central support member 534*a* and a base member 534*b* which are monolithically formed from a heat conductive material, such as cast aluminum. By casting the base and the central support member monolithically, heat dissipation from within modular printer 500 is improved. A single casting also simplifies manufacture and assembly of the modular printer. As described above with respect to modular printer 10, modular printer 500 also includes a multiplicity of unit modules which are independently attachable to and detachable from casting 534. The modules include a printhead assembly module 518, a support block assembly module 516, a thermal ink printer media take-up assembly module 512, an ink ribbon printer media take-up assembly module 512*a*, a media supply hub 630, and a stepper motor 520 (FIG. 11). Casting 534 includes recesses configured to receive each of the modules in a specific orientation such that when each of the modules is secured to casting 534, the modules are supported in an operative configuration. As such, the modular printer can be easily converted from an ink ribbon printer to a thermal ink printer by installing the appropriate print head assembly module and the appropriate media take-up assembly module into the modular printer.

Figure 10A:
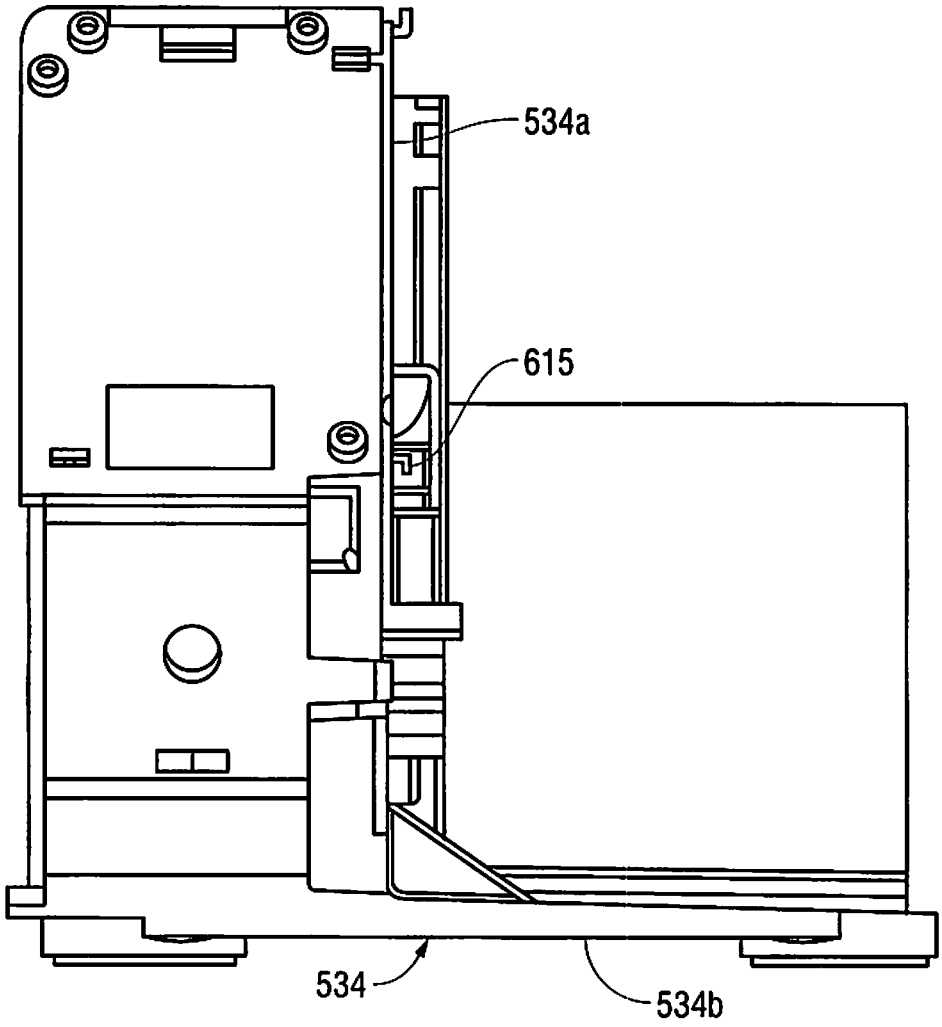
FIG. 10A is a side view of the modular printer shown in FIG. 9 with a first half of the cover and the printer modules removed.
Figure 10B:
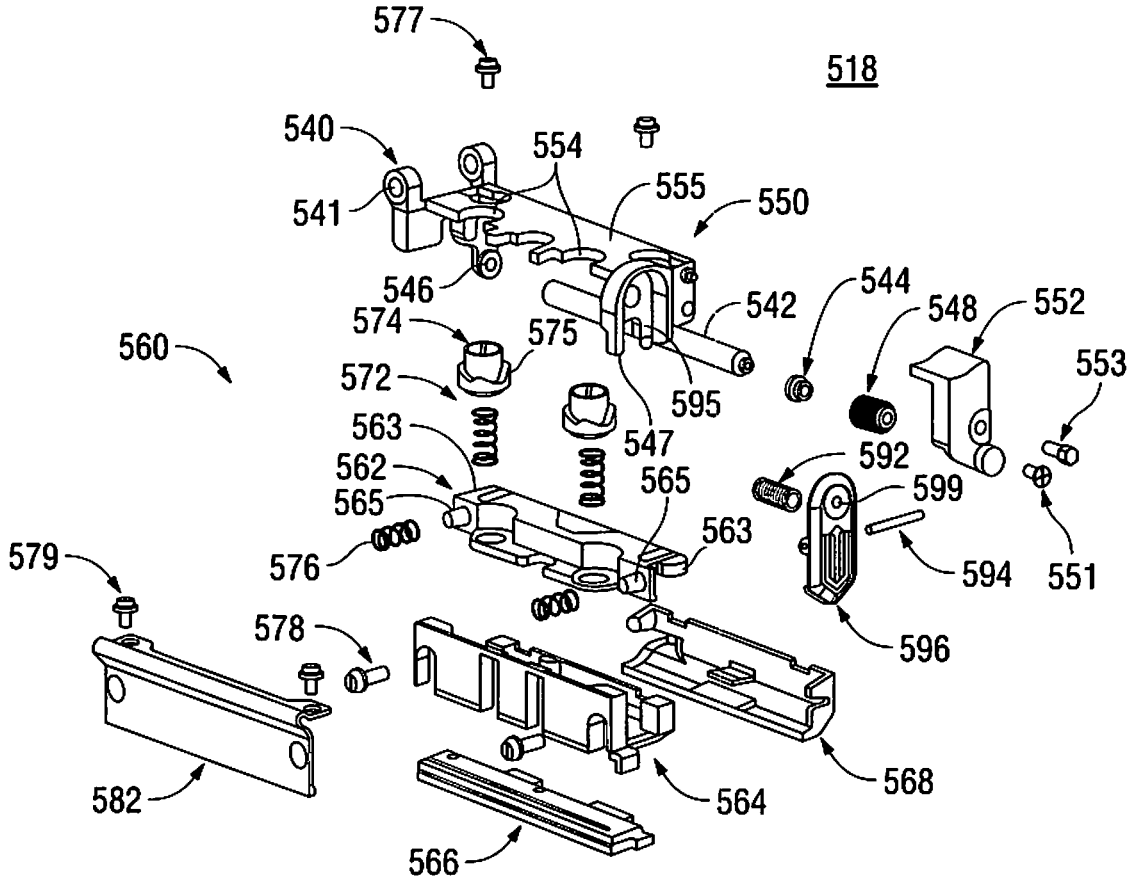
FIG. 10B is an exploded perspective view of a printhead assembly according to an embodiment of the present disclosure.

In a preferred embodiment, printhead assembly module 518 includes a platen assembly 550. In this exemplary configuration, as shown in FIG. 10B, platen assembly 550 includes a mounting block 540, a platen roller 542, first and second bearings 544, 546, a drive gear 548, and a support arm 552. First bearing 544 is attached to a first end of platen 542 and is preferably press fitted to platen roller 542. Second bearing 546 is attached to mounting block 540 such that it is substantially perpendicular to a longitudinal axis of mounting block 540. Configured thusly, second bearing 546 is configured and adapted to engage a second end of platen roller 542. Preferably, both ends of platen roller 542 are tapered, or chamfered to facilitate attachment of first and second bearings 544, 546. Drive gear 548 is attached, preferably by press fitting, to first bearing 544. As drive gear 548 rotates, it transfers rotational forces to platen roller 542, thereby causing rotational motion of platen 542. A pair of holes 541 is disposed on one end of mounting block 540 and the holes 541 are configured and adapted to pivotably engage a rod 543 (see FIG. 10).

Support arm 552 is disposed outboard of drive gear 548 and maintains the relative positions of platen roller 542 and mounting block 540. Support arm 552 is attached to mounting block 540 by a screw 553. Additionally, support arm 552 includes a screw 551 that engages a threaded recess in drive gear 548. As assembled, platen roller 542 rotates relative to mounting block 540 with first and second bearings 544, 546 reducing frictional losses during rotation of platen roller 542. Mounting block 540 includes a pair of spaced apart orifices 554 that is disposed on an upper surface 555 of mounting block 540.

Printhead assembly module 518 further includes a printhead assembly 560 that mates with platen assembly 550. Still referring to FIG. 10B, printhead assembly 560 includes an upper adjustment bracket 562 and a lower adjustment bracket 564 that are configured and adapted to engage one another. Attached to the lower adjustment bracket 564 is printhead 566. A cover 568 is provided that positively engages with the assembled upper and lower adjustment brackets 562, 564 to minimize foreign matter from entering the printhead assembly 560 and to maintain the relative positions of the printhead 566, lower adjustment bracket 564, and the upper adjustment bracket 562. Upper adjustment bracket is attached to lower adjustment bracket 564 using a pair of screws 578. Springs 576 are disposed between screws 578 and upper adjustment bracket 562. More particularly, a pair of receptacles 565 is located on a surface of upper adjustment bracket 562 that are adapted to screwingly engage screws 578 and slidingly receive springs 576 along an outer surface thereof.

A pair of knobs 574 is vertically positioned on upper adjustment bracket 562 and is biased by springs 572. Each knob 574 is configured and adapted to fit within the orifices 554 of the mounting block 540. Each rotatable knob 574 has a cam surface 575 formed thereon. The cam surface 575 of each knob 574 is urged into engagement with mounting block 540 by spring 572 such that each knob 574 extends vertically beyond upper surface 555 of mounting block 540. Upper adjustment bracket 562 includes a pair of pivot members 563, which are pivotably attached to platen assembly 550 thereby allowing printhead 566 to be selectively pivoted into a desired position relative to platen assembly 550. Both knobs 574 are selectively rotatable to urge printhead 566 towards or away from platen assembly 550 to control printhead pressure of the printhead 566. A ribbon shield 582 is provided and is attached to the upper adjustment bracket 562 using a pair of screws 579.

A printhead latch 596 is positioned on one side of mounting block 550 and is pivotably movable into and out of recess 595. A pivot member 594 extends through printhead latch 596 and engages holes 597 that are disposed in recess 595. Printhead latch 596 is biased by spring 592 that is disposed between printhead latch 596 and recess 595.

As shown in FIG. 10, a portion of printhead latch 596 releasably engages a portion of support block assembly module 516. Printhead assembly module 518 is pivotably mounted in printer 500. By applying pressure on button 599 of printhead latch 596, the normal bias of spring 592 is overcome thereby pivoting printhead latch 596 about pivot member 594 and releasing printhead latch 596 from support block assembly 516. After printhead latch 596 is released from support block assembly 516, printhead assembly module 518 is pivotable about rod 543. When the printhead assembly module 518 is pivoted away from its normal or ready position as seen in FIG. 10, replacement of the ribbon or other maintenance may be performed. Since the printhead assembly 560 and the platen assembly 550 pivot together when the printhead assembly module is pivoted, alignment between the printhead assembly 560 and platen assembly 550 is maintained.

Modular printer 500 differs from modular printer 10 described above in several respects. More specifically, modular printer 500 includes an additional idler roller 602 positioned between media supply hub 630 and printhead assembly module 518. Idler roller 602 prevents the media ribbon from becoming wrinkled during operation of the printer. Media take-up assembly 512*a* includes a ribbon supply assembly 604 and a media take-up assembly 606, each of which is detachable from and attachable to casting 534 using three screws. This allows for easy installation and removal of the media take-up assembly 512*a*. Alternately, a fewer or greater number of screws may be used to secure each roller to the casting. The electrical components of modular printer 500 are secured to central support member 534*a* on a side opposite to the printing components of printer 500. The electrical components include electronic circuitry and the drive mechanism for powering the various system modules as discussed above with respect to modular printer 10. The electronic circuitry includes circuit boards which are removably installed into a mounting bracket 608 (FIG. 11) supported on central support member 534*a*. Different circuit boards can be installed for selectively controlling operation of the printer. For example, different circuit boards or additional circuit boards may be installed to convert the printer from a thermal ink printer to an ink ribbon printer.

Figure 19:
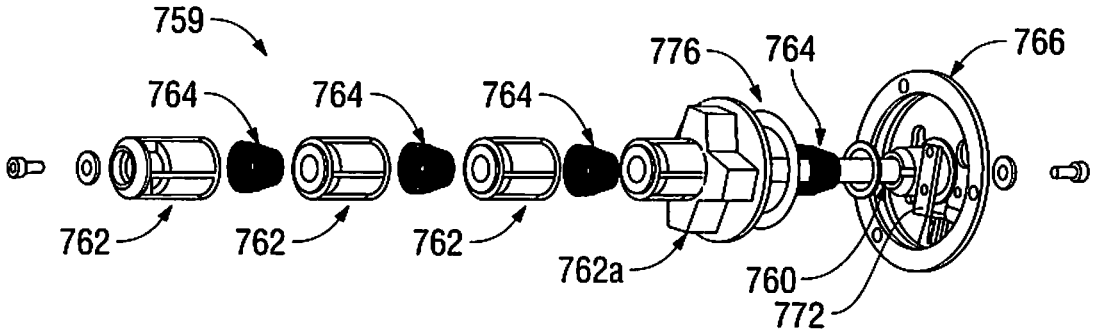
FIG. 19 is a side perspective view with parts separated of the hub assembly of the ribbon supply assembly.

Modular printer 500 also includes a pickup sensor, which communicates with the electrical circuitry of the printer and is supported on the mounting bracket or adjacent thereto to monitor operation of the ribbon supply assembly 604. By monitoring operation of the ribbon supply hub, the pickup sensor is able to track the quantity of ribbon remaining on the ribbon supply assembly 604. Details and operation of the ribbon pickup sensor are described hereinafter with reference to printer 700 and as shown in FIG. 19.

Additionally, modular printer 500 includes a media sensor assembly 524, which communicates with associated circuitry in printer 500 and is supported on portion 534*a* of casting 534, as shown in FIG. 11. Media sensor assembly 524 monitors the presence or absence of printing media, such as label stock. Further still, media sensor assembly 524 is configurable and adaptable for monitoring the printing media for indicia indicating physical boundaries, or edges of the printing media. For example, media sensor assembly 524 may monitor the printing media for a predetermined mark on the underside of the printing media. A signal is generated by the media sensor assembly 524 indicating the presence or absence of the indicator. This signal is communicated to the associated circuitry in printer 500 where the associated circuitry determines where the physical edge of the printing media is located using information included in the signal.

In addition, modular printer 500 includes a plurality of ports for communicating with external devices. As shown in FIG. 11, modular printer 500 includes a serial port (i.e. RS-232 or EIA-232) 502 and a universal serial bus (USB) port 504 that are located on a rear panel of modular printer 500. In particular, serial port 502 allows data to be transferred between modular printer 500 and an external device, while USB port 504 permits modular printer 500 to transfer data among one or more connected devices that communicate using either USB 1.0, 1.1, or 2.0 standards. It is envisioned that a USB port or a serial port may be included on printer 10 or other embodiments of printer 10 that are disclosed herein.

An example of a media sensor assembly is disclosed in U.S. Pat. No. 6,396,070 to Christensen et al., the contents of which are hereby incorporated by reference in their entirety. Another example of a media sensor assembly is disclosed in U.S. patent application Ser. No. 10/668,127, filed Sep. 22, 2003, the contents of which are hereby incorporated by reference in their entirety.

More particularly, media sensor 524 includes a sensor assembly installed above the print media. Optionally, a second sensor assembly may be placed below the print media. A sensor base is included and has rounded edges to aid in passing the print media therebetween. The sensor assembly may be used with a reflected light sensor, in which case, the sensor is both a source and a detector of light, requiring only one sensor assembly. In this case, the print media passes the sensor assembly and reflects light back to sensor assembly, which is read and processed.

Optionally, media sensor 524 includes a second sensor assembly, where the first sensor assembly transmits a light impulse from sensor source through the print media to second sensor assembly where the signal is received by a detector. Sensors can be used to determine if print media is present, to read a position indicating stripe, to determine the location of the print media edge or to measure the presence of gaps for labels. Sensor slides inside each sensor assembly are positionable to corresponding positions for accommodating differing sizes of the print media.

Modular printer 500 also includes an engagement member 615 (FIG. 10A) which extends from central portion 534*a* of casting 534 and is positioned adjacent to the pivot point of the printhead assembly module to engage printhead adjustment bracket of the printhead assembly module as adjustment bracket is pivoted towards printhead mount. The printhead adjustment bracket includes a pair of pivot members which are slidably positioned in vertical slots in the printhead pivot. As the adjustment bracket is pivoted towards printhead mount and the media positioned within the printhead assembly module 518, the printhead adjustment bracket engages member 615. Engagement between the printhead adjustment bracket and member 615 cams the pivot members upwardly in the vertical slots to lift the backend of the adjustment bracket to allow for substantially parallel closure of the bracket 587 onto the printhead mount. This parallel closure prevents crimping or gouging of the media supply.

Figure 12:
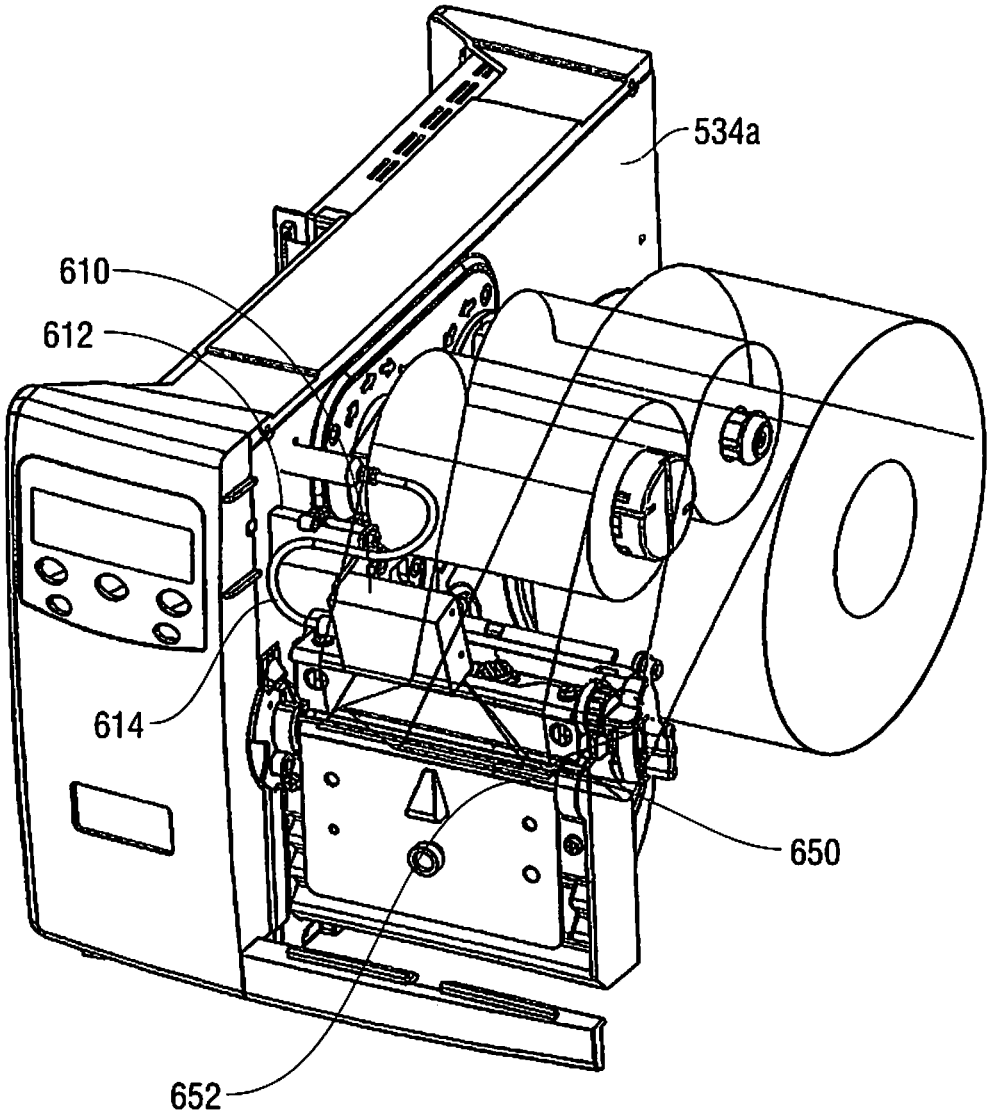
FIG. 12 is another preferred embodiment of the presently disclosed modular printer including a scanner.

As shown in FIGS. 10 and 12, a number of modular accessories can be attached/connected adjacent the front portion of the printer. These accessories in substantially self-contained units include, but are not limited to, sensors (not shown), cutters 650, peel mechanisms 652, etc. These accessories include an integral connector(s) for power and data signals.

Referring to FIG. 12, in a preferred embodiment, modular printer 500 includes a scanner 610 which is mounted on central support member 534*a* by a bracket assembly 612 which is fastened to casting 534 by two screws. Scanner 610 is electrically connected to the electrical circuitry of the modular printer 500 by a conductive cable 614. Scanner 610 can be easily removed from modular printer by disengaging the scanner from the bracket assembly or disengaging the bracket assembly from casting 534.

FIGS. 13-24 illustrate another preferred embodiment of the presently disclosed printer or print engine shown generally as 700. Printer 700 includes many of the modular features discussed above with respect to printers 10 and 500. Printer 700 offers both direct thermal printing and thermal transfer printing capabilities. Direct thermal printing uses specially treated label stock which contains dyes that turn black upon application of heat and pressure. Thermal transfer printing requires the use of a ribbon substrate having ink which is transferred onto a media upon application of heat and/or pressure to the ribbon substrate.

Figure 13:
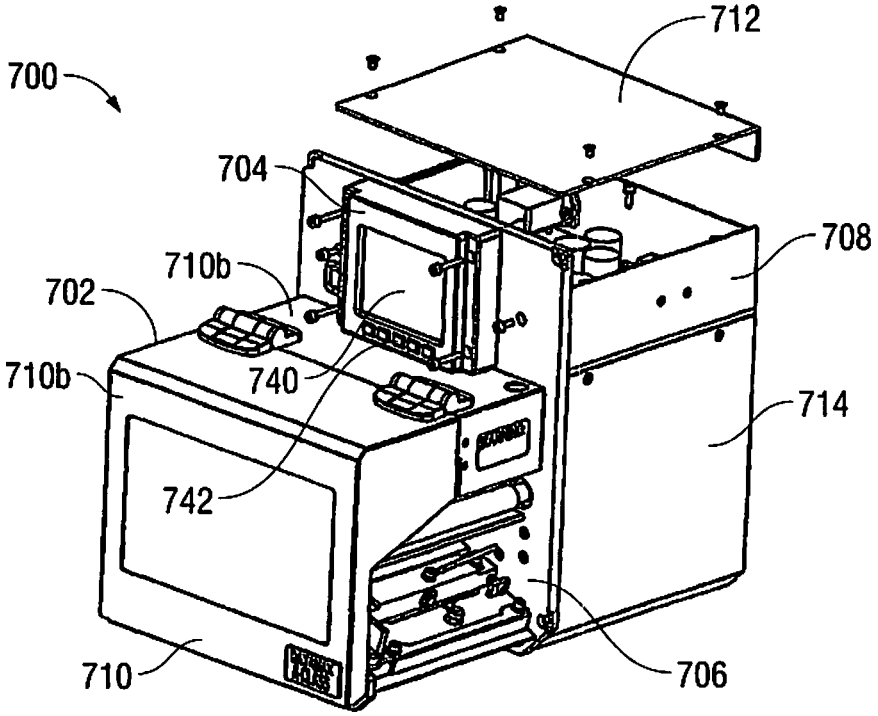
FIG. 13 is a perspective view of yet another preferred embodiment of the presently disclosed modular printer.

Referring to FIG. 13, printer 700 includes a cover assembly 702, a display assembly 704, a centerplate 706 and a power supply assembly or module 708. Cover assembly 702 includes a front cover 710 having an outer cover 710*a* and an inner cover 710*b*, a top cover 712 and a rear cover 714. Outer cover 710*a* is hingedly secured to inner cover 710*b* to facilitate easy access to the internal components of printer 700. Centerplate 706 defines an internal support wall of printer 700 and is preferably formed of a material having good heat transfer characteristics, e.g., aluminum. The electronics and drive mechanisms are supported on one side of the centerplate 706 and the printer components are supported on an opposite side or media side of centerplate 706 as will be discussed in further detail below.

Figure 14:
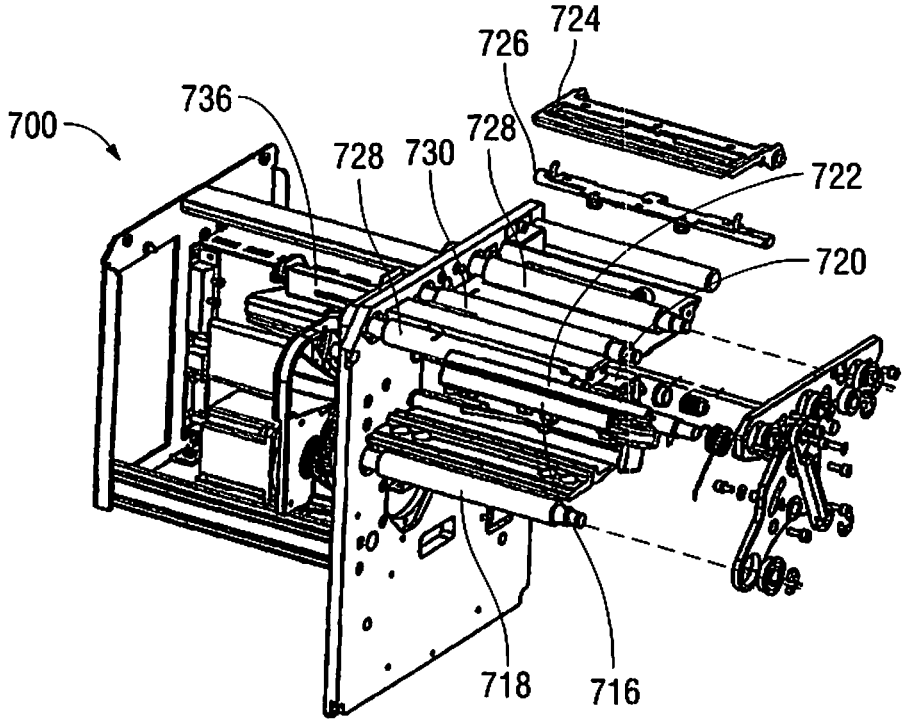
FIG. 14 is a bottom, side perspective view of the modular printer shown in FIG. 13 with the entire cover removed and the ribbon supply module and ribbon take-up module removed.
Figure 14A:
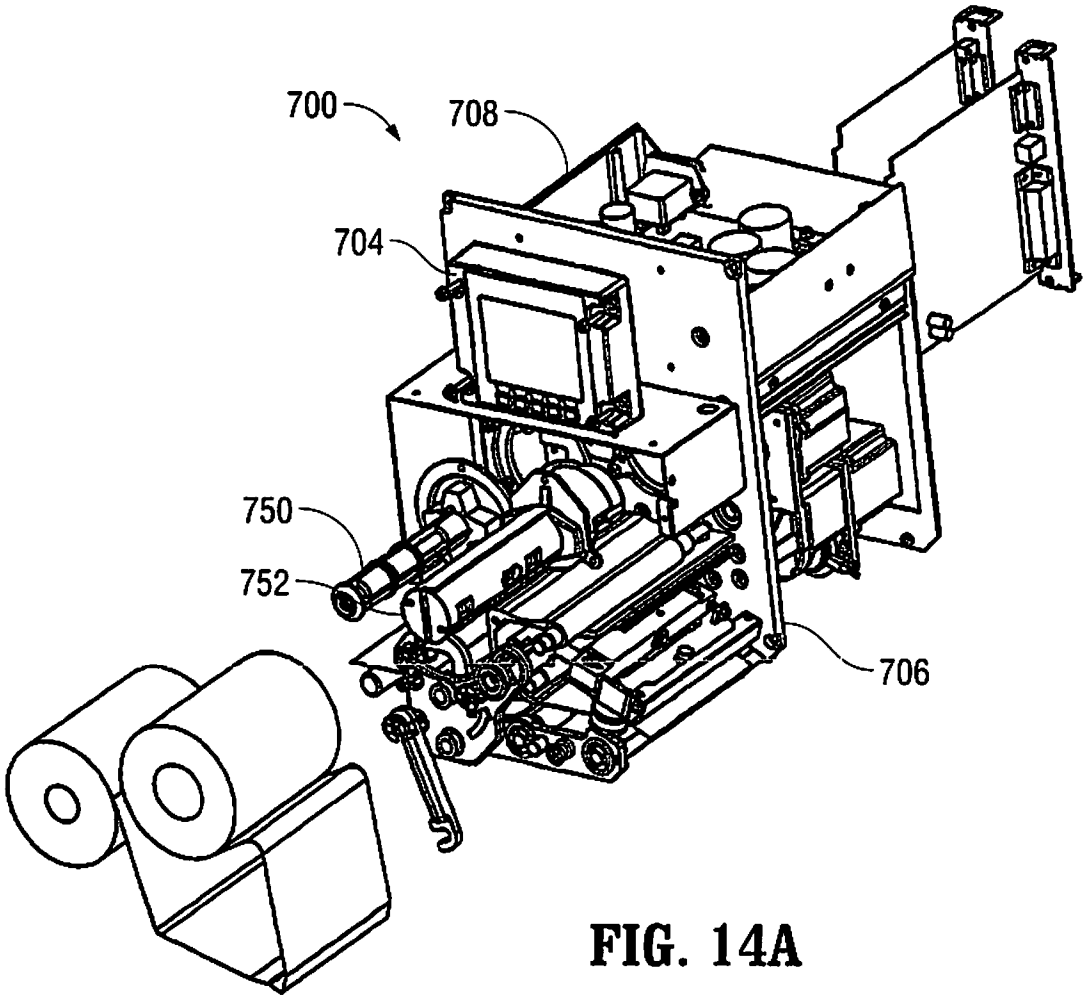
FIG. 14A is a top, front perspective view of the modular printer shown in FIG. 13 with a portion of the cover removed and a roll of ribbon and a pair of circuit boards separated therefrom.
Figure 15:
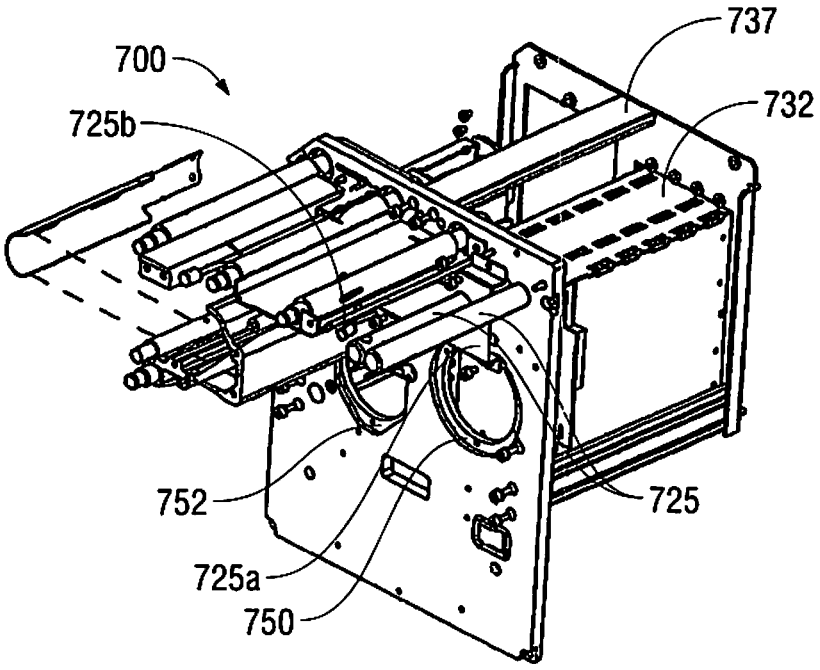
FIG. 15 is a bottom, opposite side perspective view of the modular printer shown in FIG. 14.
Figure 16:
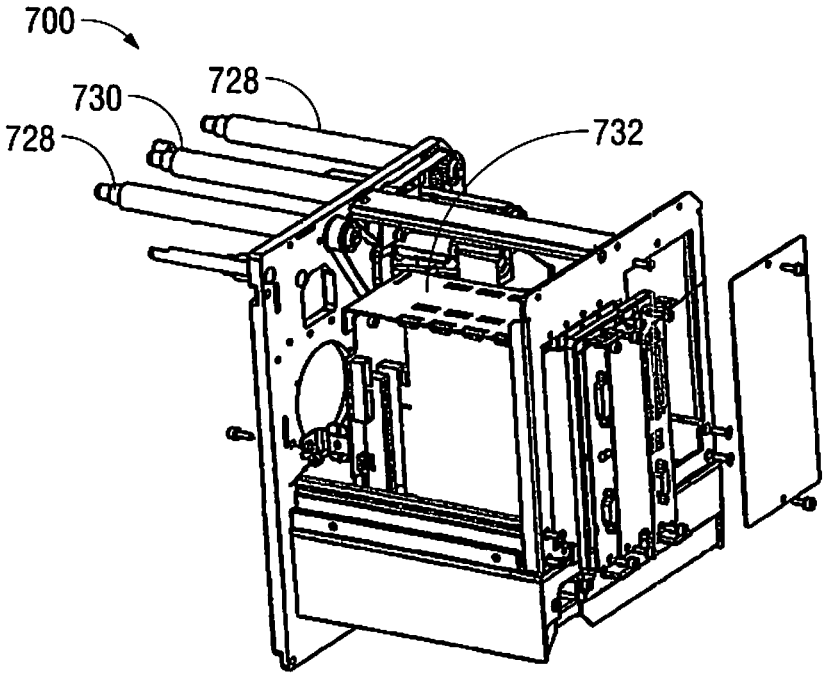
FIG. 16 is a rear perspective view of the modular printer shown in FIG. 15 with the power supply module attached to the centerplate.
Figure 17:
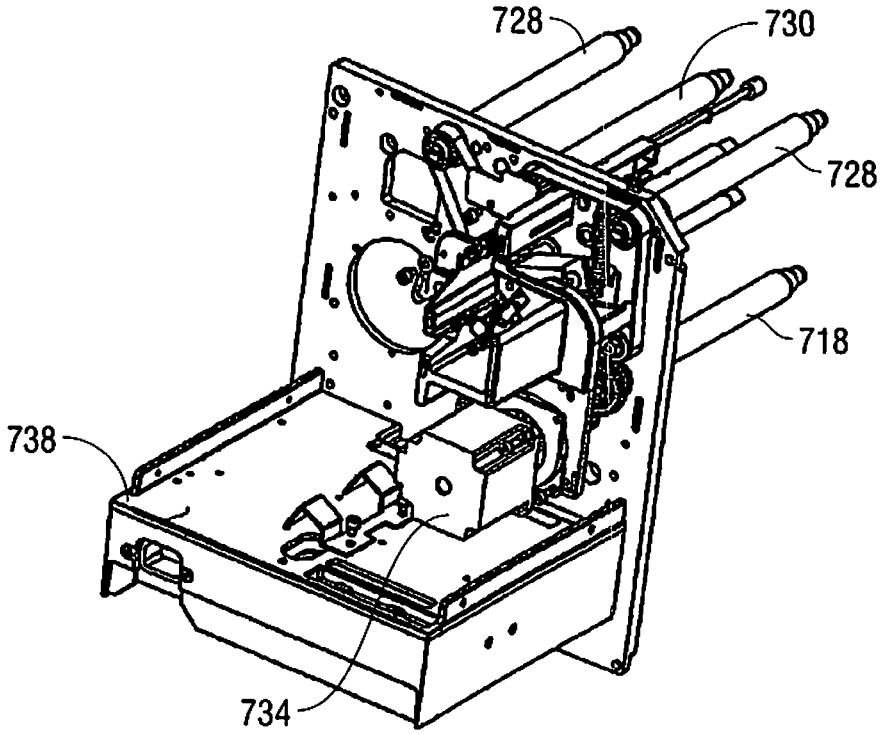
FIG. 17 is a rear bottom perspective view of the modular printer shown in FIG. 16 with the card cage assembly removed.

Referring to FIGS. 14-17, the media side of printer 700 includes a printhead assembly 716, a take-up roller assembly 718, a ribbon idler shaft 720, a peel bar 722, a pinch roller assembly 724, media posts 725, a media guide plate 725*a*, an adjustable media guide 725*b*, a latch assembly 726, a main platen roller assembly 728, and a peel plate roller assembly 730. The electronics side of printer 700 includes power supply assembly 708, a card cage assembly 732, stepper motor assembly 734 and a media sensor assembly 736 (FIG. 14). A rear support block 737 provides additional structural support to printer 700. Power supply assembly 708 is modular in construction and is supported on a support plate 738 (FIG. 17). The modular construction of power supply assembly 708 facilitates easy assembly and maintenance of printer 700. Card cage assembly 732 is configured to slidably receive the main logic card of printer 700 and applicator cards (not shown), as well as optimal electronic interface cards. Card cage assembly 732 includes printed wiring assemblies. Cage assembly 732 allows for field upgrades of printer 700 and easy servicing and maintenance.

Referring again to FIG. 14, a display assembly 704 is supported on the media side of centerplate 706. Display assembly 704 preferably includes an electronic liquid crystal graphics display 740. Preferably, display assembly 704 is rotatably mounted on printer 700 to allow for easy reading of display 740 when printer 700 is mounted upside down. The display assembly 704 identifies the status of printer 700 and includes operational and menu keys 742 which allow an operator to change parameters of printer 700 that control operation of the printer. Preferably, the display 740 is capable of displaying commands and the parameters of operation in multiple languages.

In use of printer 700, a label stock is drawn by main platen roller 728 from a supply roll located externally of printer 700 through a media sensor of media sensor assembly 736 under a thermal printhead of printhead assembly 716. The media sensor (not shown) senses the presence of label stock by sensing a top edge of a label or indicia on a bottom surface of a label which coincides with a top edge of the label. Once the edge of the label is detected, printer 700 is capable of shifting the print location to print on any desired portion of the label. When the label is passed under the thermal printhead, the printhead heats the thermally sensitive label or ribbon positioned adjacent the label to form small black dots on the label. The small dots are grouped to form characters, bar codes or graphic images. By having graphics printing capabilities, printer 700 is able to print an unlimited number of characters and, thus, can print in a variety of different languages including Chinese, Korean, Russian and Arabic. Printer 700 is also capable of printing an unlimited number of graphics including corporate logos, graphs and/or charts and an infinite variety of different symbols.

After an image is processed on the label, the label stock including a liner and label is moved past the thermal printhead and wrapped over peel bar 722 (FIG. 14) and against an overdriven roller of peel plate roller assembly 730. The overdriven roller forces a tight bend in the label stock and creates high shear stresses to form between the label and the liner. As a result of the high stresses, the label separates from the liner and is fed out of the front of the printer. The liner is fed to the rear of the media side of printer 700.

As discussed above, printer 700 is configured to accommodate easy to install modular assemblies similar to those disclosed above with respect to printer 10.

Figure 18:
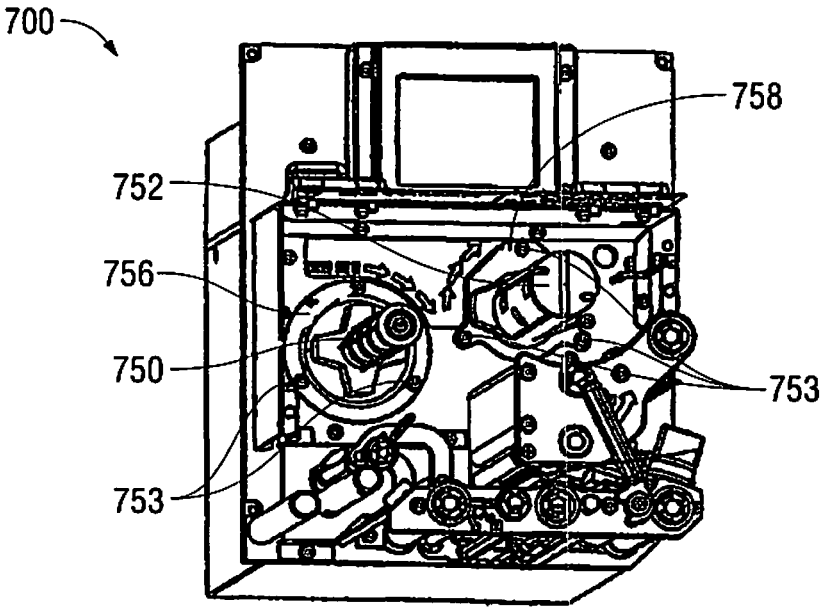
FIG. 18 is a front perspective view of the modular printer shown in FIG. 13 with the front cover removed.

Referring to FIG. 18, when printer 700 functions as a thermal transfer printing apparatus, a ribbon supply assembly or module 750 and a ribbon take-up assembly or module 752 are installed into printer 700. Preferably, recesses 756 and 758 are provided in centerplate 706 to receive and accurately position the ribbon supply and take-up modules within the media side of printer 700. One or more screws 753 may be used to secure the modules to centerplate 306.

Figure 20:
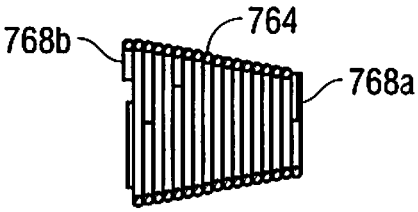
FIG. 20 is a side cross-sectional view of a torsion spring of the hub assembly shown in FIG. 19.

Referring to FIGS. 19 and 20 in a preferred embodiment, ribbon supply assembly 750 includes a hub assembly 759 including, a ribbon supply shaft 760, a plurality of hub portions 762, independently rotatably positioned about shaft 760, a plurality of torsion springs 764 positioned between adjacent hub portions 762, and a ribbon support housing 766. Each torsion spring 764 includes a bend 768*a* and 768*b* formed at each end thereof. Bend 768*a* is positioned to non-rotatably engage ribbon supply shaft 760 and bend 768*b* is positioned to non-rotatably engage a respective hub portion 762.

In use, a spool of ribbon is positioned about hub assembly 759 and is in contact with hub portions 762. Ribbon take-up assembly includes a hub (not shown) which is driven by the drive mechanism of printer 700 to unwind ribbon from the spool of ribbon positioned on hub assembly 759 of ribbon supply assembly 750. As ribbon is unwound from hub assembly 759, torque from the spool of ribbon is translated from the spool of ribbon, through hub portions 762 and torsion springs 764 to ribbon supply shaft 760. As a result, a back tension is created in the ribbon as each torsion spring is put in torque. Because the hub portions are independently rotatable about shaft 760, the amount of back tension is created in the ribbon is proportional to the width of the spool of ribbon. More specifically, if a spool of ribbon has a width equal to the length of two hub portions 762, only the torsion springs associated with the two hub portions in contact with the spool of ribbon will provide back-tension in the ribbon. As the width of the ribbon increases, additional hub portions 762 are engaged by the spool of ribbon and, thus, the additional torsion springs contribute to the back tension in the ribbon.

Referring again to FIG. 19, preferably, a sensor is provided in the ribbon supply assembly to indicate whether the ribbon supply assembly 750 is rotating and how much ribbon is remaining in ribbon supply assembly 750. In a preferred embodiment, an electronic sensor 772, e.g., laser or infrared sensor, is positioned in a ribbon support housing 766 of the ribbon supply assembly and a sensor label 776 is secured on an inner hub portion 762*a* of hub assembly 759. Electronic sensor 772 is connected to the electronic circuitry of printer 700 and is positioned to recognize when hub assembly 759 is rotating and ribbon is being unwound. In a preferred embodiment, indicia is provided on the sensor label 776 which is read by the sensor 772 as sensor label 776 rotates with hub assembly 759. For example, lamp black and silver stripes may be provided on sensor label 776. As the spool of ribbon unwinds at a particular rate, the speed of rotation of hub shaft 759 increases as the diameter of the ribbon spool decreases. Sensor 776 registers the speed of the hub assembly to provide an indication of how much ribbon is remaining on the spool. Alternately, different colors and/or indicia and/or sensor mechanisms may be provided.

Figure 19A:
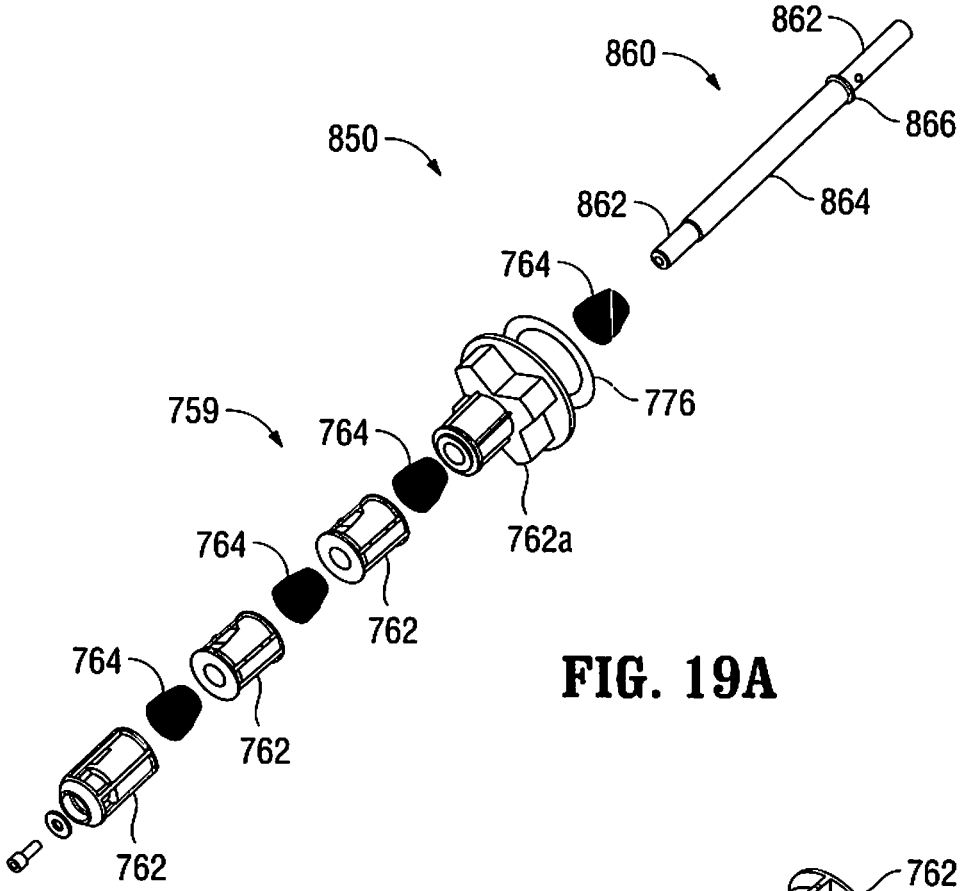
FIG. 19A is a is a side perspective view, with parts separated, of the hub assembly of the ribbon supply assembly according to another embodiment of the present disclosure.
Figure 19B:
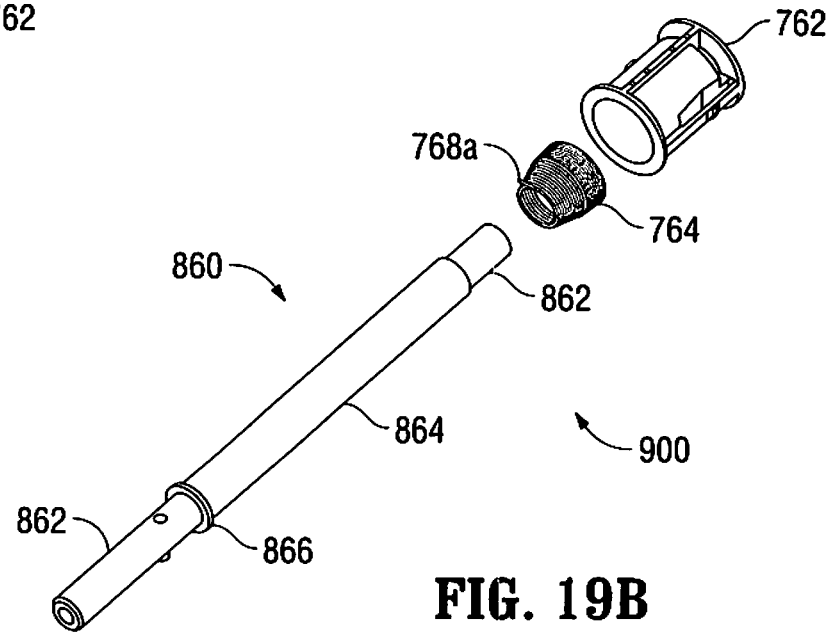
FIG. 19B is a side perspective view, with parts separated, of a clutch assembly of the ribbon supply assembly of FIG. 19A.

Referring now to FIGS. 19A, 19B, and 20, another embodiment of a ribbon supply assembly 850 is illustrated. It is contemplated that ribbon supply assembly 850 may be freely substituted for the previously disclosed ribbon supply assembly 750 (FIGS. 18, 19, and 20). Ribbon supply assembly 850 includes a hub assembly 759 including, a ribbon supply shaft 860, a plurality of hub portions 762, independently rotatably positioned about shaft 860, a plurality of torsion springs 764 disposed inside hub portions 762, and a ribbon support housing 766 (FIG. 19).

Ribbon supply shaft 860 includes an elongate tubular rod 862 having a stop member 866, and a sleeve 864. Stop member 866 is fixedly attached to rod 862 and spaced from an end thereof. It is contemplated that stop member 866 may be integrally formed with rod 862 or may be a discrete component that attacked to rod 862. Sleeve 864 fits over a portion of rod 862 such that ends of rod 862 extend beyond sleeve 864. Sleeve 864 and rod 862 are configured and dimensioned such that they frictionally engage one another such that sleeve 864 and rod 862 do not separate during operation of printer 700. In addition, sleeve 864 may be formed from a suitable material (i.e. plastic). Each torsion spring 764 includes a bend 768*a* and 768*b* formed at each end thereof (FIG. 20). Bend 768*a* is positioned such that it non-rotatably engages sleeve 864 and bend 768*b* is positioned such that it non-rotatably engages a respective hub portion 762.

Ribbon supply 850 may include a sensor, as previously discussed with respect to ribbon supply 750 (FIG. 19), to indicate whether the ribbon supply assembly 850 is rotating and how much ribbon is remaining in ribbon supply assembly 850.

With reference now to FIG. 19A, clutch assembly 900 is illustrated. Clutch assembly 900 includes sleeve 864, at least one hub portion 762, and at least one torsion spring 764 operatively associated with the at least one hub portion 762. Clutch assembly 900 is a reversible or bi-directional clutch. Specifically, as will be detailed below, clutch assembly 900 is adapted to transmit rotational movement to ribbon supply shaft 860 in either the clockwise or counter-clockwise direction of rotation.

In use, a spool of ribbon is positioned about hub assembly 759 and is in contact with hub portions 762. Ribbon take-up assembly includes a hub (not shown) which is driven by the drive mechanism of printer 700 to unwind ribbon from the spool of ribbon positioned on hub assembly 759 of ribbon supply assembly 850. As ribbon is unwound from hub assembly 759 in a first direction (i.e. clockwise), torque from the spool of ribbon is translated from the spool of ribbon to ribbon supply shaft 860 through clutch assembly 900. Specifically, an inner surface of hub portion 762 frictionally engages bend 768*b* of torsion spring 764 thereby creating a back tension in the ribbon as each torsion spring 764 of clutch assembly 900 frictionally engages a respective hub portion 762. During rotation in the first direction, bend 768*a* does not frictionally engage sleeve 864, but slides along a surface thereof without affecting the engagement of bend 768*b* and hub portion 762. Although bend 768*a* of torsion spring 764 does not frictionally engage sleeve 864, a back tension in a second direction is created as bend 762*a* slides along sleeve 864. Because hub portions 762 are independently rotatable about shaft 860, the amount of back tension is created in the ribbon is proportional to the width of the spool of ribbon. More specifically, if a spool of ribbon has a width equal to the length of two hub portions 762, only the torsion springs associated with the two hub portions in contact with the spool of ribbon will provide back-tension in the ribbon. As the width of the ribbon increases, additional hub portions 762 are engaged by the spool of ribbon and, thus, the additional torsion springs contribute to the back tension in the ribbon.

As ribbon is unwound from hub assembly 759 in a second direction (i.e. counter-clockwise), torque from the spool of ribbon is translated from the spool of ribbon, through clutch assembly 900. Specifically, bend 768*a* of torsion spring 764 frictionally engages sleeve 864 of ribbon supply shaft 860 thereby creating a back tension in the ribbon as each torsion spring 764 frictionally engages sleeve 864. Although bend 768*b* of torsion spring 764 does not frictionally engage hub portion 862, a back tension in the first direction is created as bend 762*b* slides along hub portion 862. During rotation in the second direction, bend 768*b* does not frictionally engage hub portion 762, but slides along a surface thereof without affecting the engagement of bend 768*a* and sleeve 864. Because hub portions 762 are independently rotatable about shaft 860, the amount of back tension is created in the ribbon is proportional to the width of the spool of ribbon. More specifically, if a spool of ribbon has a width equal to the length of two hub portions 762, only the torsion springs associated with the two hub portions in contact with the spool of ribbon will provide back-tension in the ribbon. As the width of the ribbon increases, additional hub portions 762 are engaged by the spool of ribbon and, thus, the additional torsion springs contribute to the back tension in the ribbon.

By providing bi-directional clutch assembly 900, rotation of the ribbon supply in either the clockwise direction or the counter-clockwise direction provides a predetermined amount of back tension in the ribbon supply in both the clockwise and counter-clockwise directions of rotation. The number of torsion springs that engage either sleeve 864 or hub 762 contributes to the amount of back tension in the ribbon supply.

In a preferred embodiment, printer 700 includes a ribbon saver mechanism that permits the feeding of label stock independently of the supply of ribbon to allow for printing on only a small portion of the label. The ribbon saver mechanism includes a motor assembly 780 (FIG. 21) and a cam assembly 782 (FIG. 22) which function to lift the printhead of printhead assembly at a prescribed moment, i.e., when the desired printing operation is complete, and a brake assembly 784 for stopping rotation of the ribbon supply assembly 750.

Figure 21:
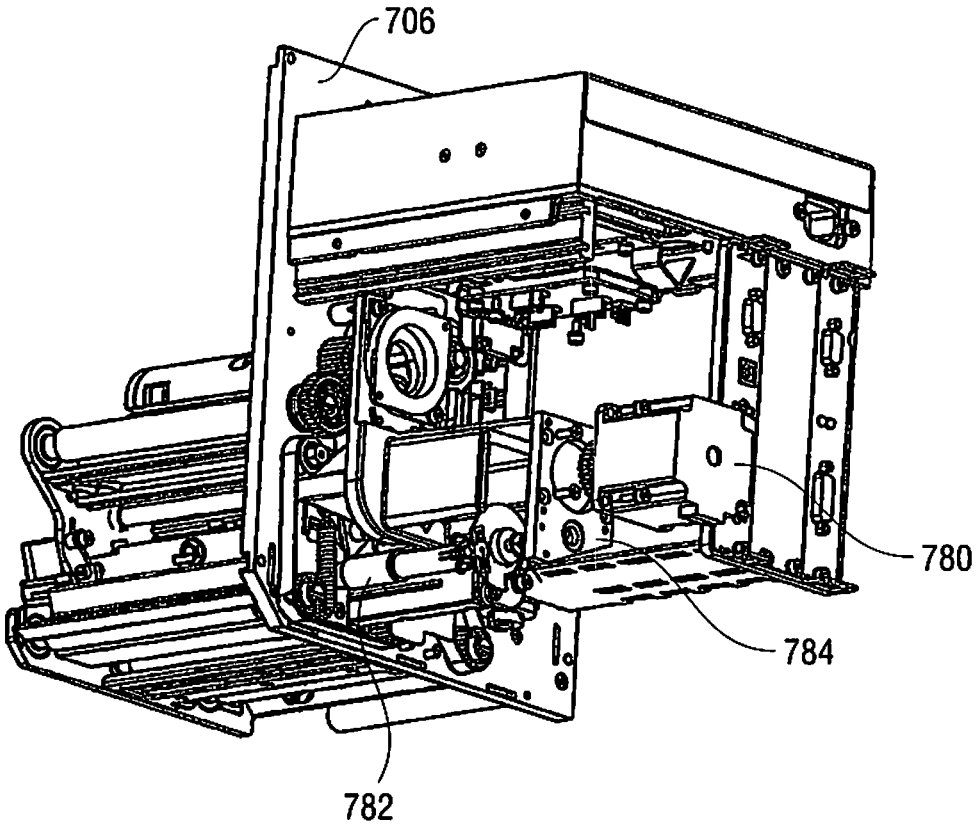
FIG. 21 is a side perspective view of the modular printer shown in FIG. 16 with the motor and cam assembly of the ribbon saver mechanism secured thereto.
Figure 22:
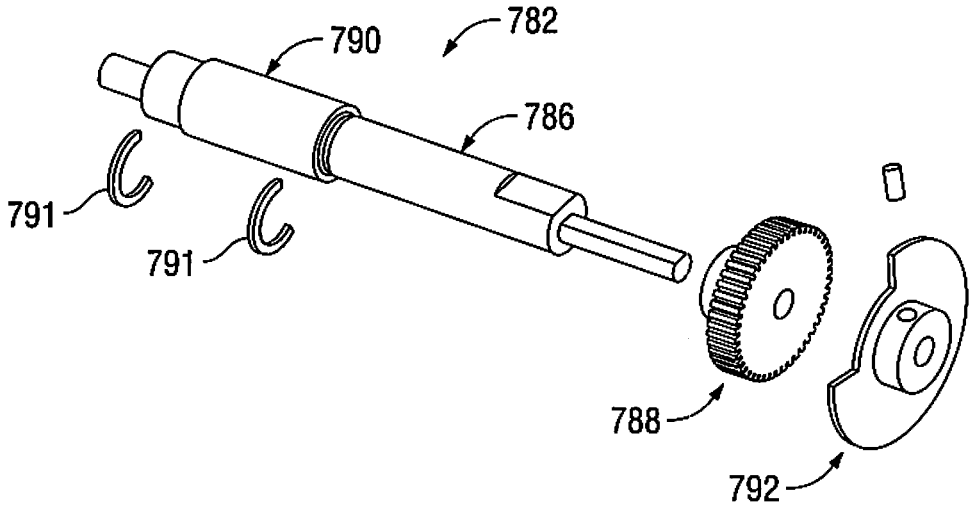
FIG. 22 is a side perspective view of the cam assembly of the ribbon saver mechanism of the modular printer shown in FIG. 21.

Referring to FIGS. 21 and 22 motor assembly 780 of the ribbon saver mechanism is mounted on the electronics side of centerplate 706 as a module which is secured to a motor mounting plate 784. Cam assembly 782 includes a shaft 786 which is rotatably supported between centerplate 706 and motor mounting plate 784. Shaft 786 has a gear 788 mounted on one end thereof and an eccentric bushing 790 positioned on an opposite end thereof. Bushing 790 is axially fixed on shaft 786 between two C-clips 791. See FIG. 22. The eccentric bushing 790 is positioned beneath one end of printhead assembly 716. Motor assembly 780 is operably engaged with gear 788 of cam assembly 782 such that when motor assembly 780 is actuated, shaft 786 is rotated to rotate eccentric bushing 790 beneath printhead assembly 716. Rotation of bushing 790 effects movement of the printhead of printhead assembly 716 between raised and lowered positions. A timing disk 792 (FIG. 22) is secured to shaft 786 adjacent gear 788. Timing disk 792 rotates with shaft 786 and includes a cutout 792*a* which operates a limit switch (not shown) to control operation of motor assembly 780.

Figure 23:
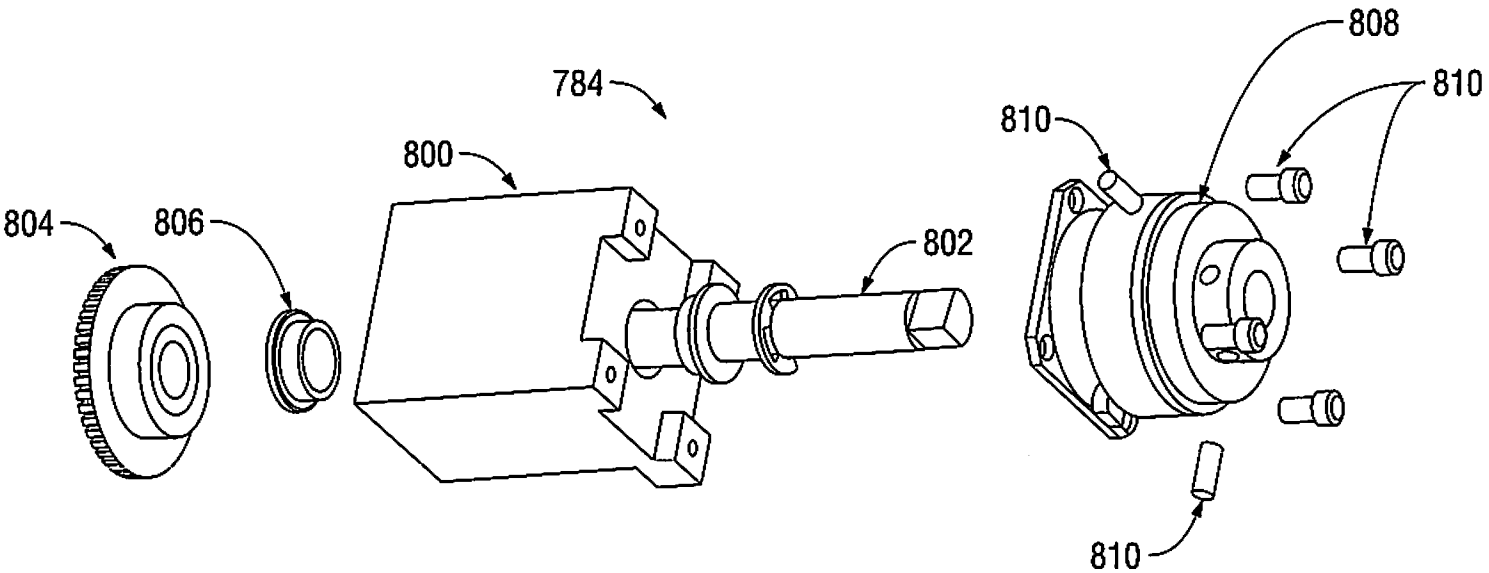
FIG. 23 is a side perspective view with parts separated of the brake assembly of the ribbon saver mechanism.
Figure 24:
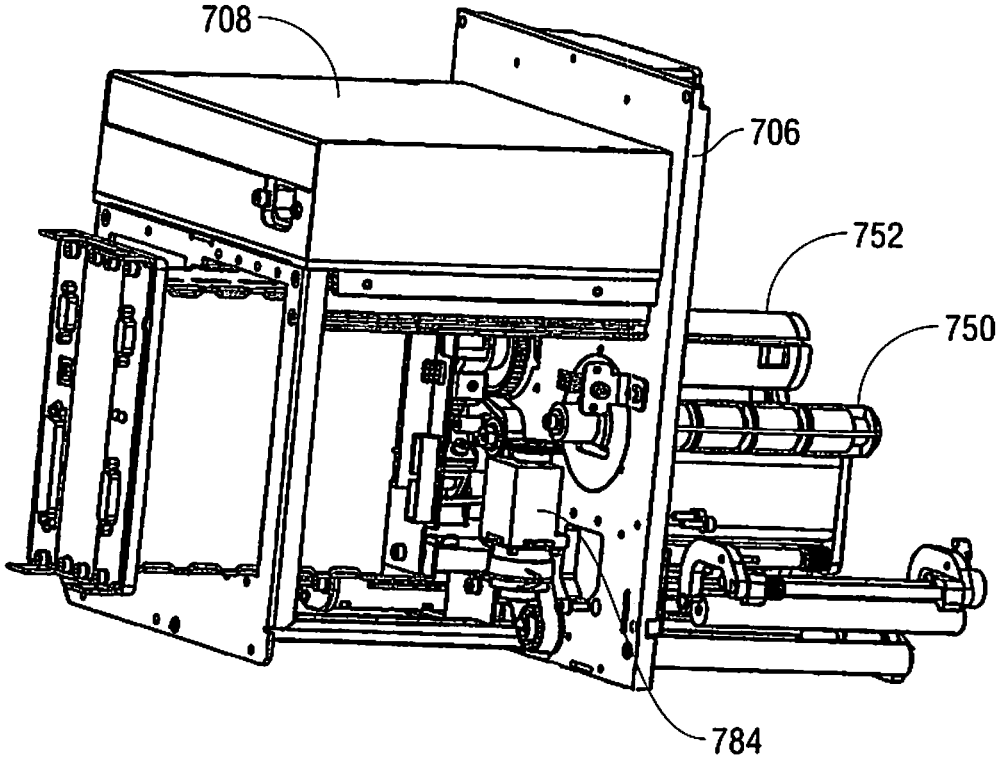
FIG. 24 is a side perspective view of the modular printer shown in FIG. 16 with the brake assembly of the ribbon saver mechanism secured thereto.

Referring to FIGS. 23 and 24, brake assembly 784 includes a mounting block 800 which is secured adjacent centerplate 706 on the electronics side of printer 700. A brake shaft 802 is rotatably positioned within a throughbore formed in mounting block 800. A bevel gear 804 and bearing 806 are secured to one end of shaft 802. An opposite end of shaft 802 extends through a brake 808. Brake 808 is preferably an electronically actuated brake although other known braking mechanisms may also be used. Brake 808 is secured to mounting block 800 with screws 810. Bevel gear 804 is positioned to engage a bevel gear (not shown) formed on an end of ribbon supply shaft 760 of ribbon supply assembly 750. Thus, rotation of ribbon supply shaft 760 effects rotation of bake shaft 802. When brake 808 is actuated, brake shaft 802 is prevented from rotating to prevent bevel gear 804 from rotating. Since bevel gear 804 is enmeshed with the bevel gear secured to ribbon supply shaft 760, ribbon supply shaft 760 is prevented from rotating and ribbon cannot be unwound from ribbon supply assembly 750.

In summary, when the ribbon saver mechanism is actuated, motor assembly 780 operates a cam assembly 782 to lift the printhead of the printhead assembly 716 away from the main platen roller 728 (FIG. 14), and brake 808 is actuated to prevent rotation of ribbon supply shaft 760. With the ribbon supply shaft locked and the printhead lifted, the label stock is fed through the printer independent of ribbon and no ribbon is consumed.

Printer engine 700 is similar in construction to modular printers 10 and 500 in that printer 700 includes a central support member 706 having printer modules supported on a first side of support member 706 and the electrical and drive components secured to an opposite side of support member 706. In addition to those components disclosed above, printer 700 includes at least two additional driven rollers to independently control movement of the media and ribbon within the printer. The rollers may be independently driven or driven by a common driver. The driven rollers include a drive roller or hub 728 for controlling movement of media and a second drive roller 732 for controlling movement of ribbon. Because drives are provided for the media and the ribbon, the ribbon need not be continuously driven through the printhead assembly with the media, but rather need only be driven through the printhead assembly when actual printing onto the media is occurring. As a result, a substantial reduction in the quantity of ribbon required to operate the printer is achieved. Software or control circuitry is provided to coordinate operation of the ink ribbon drive roller with operation of the printhead assembly.

It will be understood that various modifications may be made to the embodiments disclosed herein. For example, all of the components need not be configured as modules, i.e., only one or some of the components may be configured in module form. Therefore, the above description should not be construed as limiting, but merely as exemplifications of preferred embodiments. Those skilled in the art will envision other modifications within the scope and spirit of the claims appended hereto.

What is claimed is:

1. A printer comprising:

a support housing configured for selective attachment to a baseplate or an extension member;

a baseplate configured for selective attachment to the support housing or an extension member;

a rotatable take-up assembly operably connected to said support housing;

a rotatable supply assembly operably connected to said support housing;

a first motor assembly operatively coupled to said rotatable take-up assembly, wherein the rotatable take-up assembly and the rotatable supply assembly are adapted and configured to receive a quantity of a printing medium; and an extension member configured for selective attachment to the baseplate and the support housing and selectively attached to the baseplate and the support housing such that the support housing is selectively spaced relative to the baseplate.

2. The printer of claim 1, wherein a height of the extension member measures 4", 6" or 8".

3. The printer of claim 1, wherein rotation of the first motor assembly in a first direction transports the print media onto the rotatable take-up assembly.

4. The printer of claim 1, wherein the support housing includes a plurality of recesses and each of the recesses are configured to receive one of the assemblies of the printer at a position to align the assembly with the other assemblies of the printer in an operational configuration.

5. The printer of claim 4, further comprising a printhead assembly having first and second latch arms attached to a camshaft, wherein rotation of the camshaft in a first direction engages the latch arms with edges of a printhead thereby securing the printhead in proximity to a platen and rotation of the camshaft in a second direction disengages the latch arms from the edges of the printhead thereby separating the printhead from the platen.

6. The printer of claim 5, wherein rotation of the camshaft in a first direction causes the printhead to apply a substantially uniform pressure to the platen.

7. The printer of claim 5, wherein the baseplate and each assembly are selected to correspond to a width of a first print media such that when a second print media having a different width is installed, the baseplate and each assembly module are replaceable with a baseplate and assemblies corresponding to the width of the second print media.

8. The printer of claim 1, wherein the take-up assembly includes a hub assembly, a support disc and a retainer.

9. The printer of claim 8, wherein the retainer is releasably attached to the hub assembly.

10. The printer of claim 1, further comprising a second motor assembly being operatively coupled to a controller and the controller adjusts a current value applied to said second motor assembly and rotation of the second motor assembly is proportional to the applied current value, the second motor assembly including a DC stepper motor.

11. The printer of claim 1, further comprising at least one communication port selected from the group consisting of serial, parallel, and USB.

12. The printer of claim 1, further comprising:

a USB controller operatively coupled to a USB port.

* * * * *